US011745905B2

(12) United States Patent
Roberts et al.

(10) Patent No.: US 11,745,905 B2
(45) Date of Patent: Sep. 5, 2023

(54) SYSTEMS AND METHODS FOR MONITORING AND VALIDATING OPERATIONS OF A BANDING TOOL

(71) Applicant: Band-It-IDEX, Inc., Denver, CO (US)

(72) Inventors: Braden Andrew Roberts, Denver, CO (US); Kevin Wagner, Denver, CO (US)

(73) Assignee: Band-It-IDEX, Inc., Denver, CO (US)

( * ) Notice: Subject to any disclaimer, the term of this patent is extended or adjusted under 35 U.S.C. 154(b) by 214 days.

(21) Appl. No.: 17/139,664

(22) Filed: Dec. 31, 2020

(65) Prior Publication Data

US 2021/0354863 A1 Nov. 18, 2021

Related U.S. Application Data

(60) Provisional application No. 63/040,076, filed on Jun. 17, 2020, provisional application No. 63/036,855, filed on Jun. 9, 2020, provisional application No. 63/026,967, filed on May 19, 2020, provisional application No. 63/023,653, filed on May 12, 2020.

(51) Int. Cl.

| | |
|---|---|
| ***B65B 13/02*** | (2006.01) |
| ***B65B 13/22*** | (2006.01) |
| ***B65B 61/06*** | (2006.01) |

(52) U.S. Cl.

CPC ..... *B65B 13/22* (2013.01); *B65B 61/06* (2013.01)

(58) Field of Classification Search

CPC ..... B65B 13/22; B65B 61/06; B65B 13/027

See application file for complete search history.

(56) References Cited

U.S. PATENT DOCUMENTS

| | | | |
|---|---|---|---|
| 7,650,680 | B2 | 1/2010 | Stillings et al. |
| 8,331,641 | B2 | 12/2012 | Valadez et al. |
| 8,356,641 | B2 | 1/2013 | Marelin et al. |
| 8,424,166 | B2 | 4/2013 | Dorneman et al. |
| 11,053,034 | B1 * | 7/2021 | Sikora ..... B65B 13/186 |
| 2002/0129866 | A1 | 9/2002 | Czebatul et al. |

(Continued)

FOREIGN PATENT DOCUMENTS

| | | |
|---|---|---|
| CN | 201176007 | 1/2009 |

OTHER PUBLICATIONS

International Search Report and Written Opinion for International (PCT) Patent Application No. PCT/US2020/67709, dated Mar. 26, 2021 11 pages.

(Continued)

*Primary Examiner* — Anna K Kinsaul
*Assistant Examiner* — Himchan Song
(74) *Attorney, Agent, or Firm* — Sheridan Ross P.C.

(57) ABSTRACT

Systems and methods are provided for validating a tensioning and locking procedure for a band using a banding tool and for determining at least one characteristic of the banding tool for determining whether a component needs repair or replacement. The systems and methods include receiving data from one or more sensors disposed on a banding tool, validating and releasing one or more components of the tool based on the data meeting one or more thresholds, and/or determining that the one or more components of the tool requires repair or replacement. The systems and methods also provide for predictive maintenance based on the received data.

20 Claims, 16 Drawing Sheets

(56) References Cited

U.S. PATENT DOCUMENTS

| | | | | |
|---|---|---|---|---|
| 2012/0118176 | A1* | 5/2012 | Gregersen | B65B 13/22 100/2 |
| 2017/0096269 | A1* | 4/2017 | Marelin | B65D 63/06 |
| 2017/0349307 | A1 | 12/2017 | Seelos et al. | |
| 2018/0346161 | A1* | 12/2018 | Frink | F16L 33/023 |
| 2019/0160856 | A1* | 5/2019 | Middelberg | B65H 45/14 |
| 2019/0248521 | A1* | 8/2019 | Hillegonds | B65B 13/187 |
| 2020/0262592 | A1* | 8/2020 | Melias | B65B 57/02 |
| 2020/0277090 | A1* | 9/2020 | Keller | B65B 57/12 |
| 2020/0361644 | A1* | 11/2020 | Hochstrasser | B65B 13/025 |
| 2021/0354863 | A1* | 11/2021 | Roberts | B65B 57/18 |
| 2023/0088358 | A1* | 3/2023 | Sikora | B65B 13/327 |

OTHER PUBLICATIONS

International Preliminary Report on Patentability for International (PCT) Patent Application No. PCT/US2020/067709, dated Nov. 24, 2022 6 pages.

* cited by examiner 1002
1012

1010

| | Occurrence | | | | | | | | | |
|---|---|---|---|---|---|---|---|---|---|---|
| | 1 | 2 | 3 | 4 | 5 | 6 | 7 | 8 | 9 | 10 |
| Velocity | 8 | 8.7 | 8.2 | 8.5 | 7.5 | 6.8 | 5.2 | 5 | 5.2 | 4.8 |
| Motor Torque | 70 | 71 | 70 | 70 | 75 | 80 | 77 | 80 | 77 | 79 |
| Punch Pressure | 50 | 51 | 50 | 52 | 55 | 53 | 55 | 56 | 58 | 60 |
| Motor Speed (No. of Revs.) | 400 | 403 | 450 | 455 | 456 | 455 | 460 | 465 | 485 | 480 |
| Air Flow Rate | 20 | 21 | 20 | 21 | 26 | 20 | 21 | 22 | 21 | 20 |
| Time to Target Punch Pressure (s) | 50 | 51 | 49 | 50 | 52 | 60 | 62 | 61 | 65 | 67 |

1014

SYSTEMS AND METHODS FOR MONITORING AND VALIDATING OPERATIONS OF A BANDING TOOL

CROSS-REFERENCE

The present disclosure claims the benefit of U.S. Provisional Application Nos. 63/026,967 filed on May 19, 2020 and entitled "Band Clamping Apparatus; 63/023,653 filed on May 12, 2020 and entitled "Band Clamping Apparatus with Punch Velocity Measurement Device"; 63/036,855 filed Jun. 9, 2020 and entitled "Band Clamping Apparatus; and 63/040,076 filed on Jun. 17, 2020 and entitled "Systems and Methods for Validating Operations of a Banding Tool," each of which applications are incorporated herein by reference in their entireties.

FIELD OF INVENTION

Embodiments of the present invention are related generally to banding tools, and in particular to a method and apparatus that senses, monitors, and validates operations (e.g., tensioning and/or locking procedure) for a banding tool and/or determines at least one characteristic (e.g., wear, breakage, etc.) of a component based on data received from one or more sensors associated with the banding tool.

BACKGROUND

Many types of bands have been devised or advanced for use in clamping workpieces or objects, such as hoses, pipes, poles, cables and the like. Bands generally are combined with an associated buckle, clasp, clamp, seal or other locking member (collectively referred to herein as a buckle for simplicity) that maintains the wrapped band in a tensioned state about one or more objects. The buckle may be separate from or integral with the band. Bands may be pre-formed prior to installation, in which the band is wrapped about itself to form a closed loop, with the leading or free end of the band positioned through and extending away from the buckle. Such pre-formed bands are subsequently placed about a work piece, i.e., the objects to be bound, and then fully tightened using a clamping tool. Alternatively, some bands are not pre-formed but include a free end that is initially wrapped about the work piece to form a closed loop about the work piece, wherein the leading or free end is then introduced into the buckle by the operator. A tool is typically used to complete tensioning to a predetermined or specified level and then to lock the buckle relative to the band and sever an excess length of the band.

Various devices have been implemented or disclosed that are intended to enhance or facilitate band tensioning. These devices may be stationary or fixed in position or they may be hand-held. In many instances, such devices also cut off the leading portion of the band after it has been tensioned and create the lock between the band and buckle that maintains the desired tension of the band about the workpiece or clamped object. Devices that perform the tightening, locking and cutting functions may be manual, pneumatic, electric or a combination thereof in operation. Pneumatic and electric devices accomplish the tasks of tensioning, locking and cutting with limited or reduced human effort. Band tightening devices that are pneumatic or electric are usually semiautomatic in that the operator is required to perform some, but not all, of the tasks or associated operations. Manual tasks that remain may include locating the band about the object, inserting or otherwise locating the leading end of the band relative to or through a buckle and positioning the leading end in a tensioning device to initiate tightening of the band about a work piece. In one known pneumatic band tightening apparatus, a desired tension is preset. A pneumatic cylinder is activated to engage and pull on the leading end of the band until a desired band tension is reached. Pneumatic control may also be involved in forming the lock and cutting the excess leading end portion after the band is tightened and secured with the buckle.

Examples of bands and banding tools that are relevant to the subject matter of the present disclosure are described in U.S. patent application Ser. No. 15/282,685 and U.S. Pat. Nos. 7,650,680; 8,331,641; 8,356,641; and 8,424, 166, assigned to Band-It/IDEX, Inc. The entirety of each patent is incorporated herein by reference.

Current tool technology is susceptible to operator influence. The quality of the locked or secured band may vary among operators and by the same operator. Repeatability of the locking operation and the desired and achieved retained force or lock strength cannot be assured. In addition, over time, tool performance degrades often slowly and without operator awareness. Declining tool performance also adversely affects the quality of the retained force or lock strength and cannot be determined without destructive testing. Further, various components of the tool may malfunction during operation without operator awareness, thereby also affecting the quality of the band locking operation.

SUMMARY

An objective of a tool according to aspects of the present disclosure is to assess and validate certain input characteristics using various sensor assemblies that correlate with and define the final lock or clamp performance and also to use such input characteristics to identify immediate repairs, preventative maintenance schedules, replacement, or improvements to components of the tool. Such input characteristics include tool system pressure, punch cylinder pressure, buckle and band alignment relative to the tool and workpiece, motor torque and punch velocity. Achieving overall system pressure is critical to the overall performance of the tool. Minimum threshold system pressure varies based upon the type of band and buckle involved and the specified or targeted retained or lock strength. Punch cylinder pressure is critical to achieve the intended punch velocity. Inadequate punch velocity can fail to achieve correct buckle deformation and retained strength. Additionally, misalignment of the buckle and band relative to the path of the punch can lead to a buckle that is mis-formed or not optimally formed relative to the band, reducing retained force, and misalignment of the buckle relative to the workpiece during band tensioning can also dramatically reduce retained force. Sensing and monitoring each of these characteristics and providing feedback to the operator of these sensed characteristics facilitates achieving consistent, repeatable and targeted lock performance and reduces the quantity of buckles that may fail prematurely.

It would be advantageous to provide for monitoring, collecting, and analysis of data received from sensors disposed on the banding tool to validate the banding process and/or to determine predictive maintenance schedules or identify repairs needed to the tool. Such validation and determination of maintenance and/or repairs of various components of the tool ensures that a resulting locked or secured band produced by a tool was properly installed and reduces downtime associated with a malfunctioning tool.

In one embodiment according to the aspects of the present disclosure, a method for validating a tensioning and locking procedure for a band may comprise receiving data from one or more sensors disposed on a banding tool. The method may also include releasing or activating a first component of the banding tool when a first set of data meets a first predetermined threshold. The method may further include releasing or activating a second component of the banding tool when a second set of data meets a second predetermined threshold.

The banding tool may comprise a band tensioning assembly, a punch assembly and a cutting assembly. The data may have one or more of positioning data from a position sensor assembly corresponding to a position of a buckle of a band relative to the punch assembly, punch data corresponding to a pressure of a punch cylinder of the punch assembly, tangency data from a tangency sensor assembly corresponding to a position of a workpiece relative to the buckle, velocity data from a velocity sensor assembly corresponding to a velocity of a punch piston (and thus a punch), and tensioning data corresponding to a tensioning of the band when the band is in the band tensioning assembly. The first component may comprise a punch of the punch assembly, the first set of data may comprise one or more of the positioning data, the tangency data, and the punch data, and the first predetermined threshold may comprise one or more of a buckle positioning threshold, a tangency threshold, and a punch threshold. For example, the punch may release or be activated when the positioning data meets the positioning threshold indicating that a buckle of the band is in alignment with the workpiece, the tangency data meets the buckle tangency threshold indicating that a buckle of the band is in alignment with the workpiece, and the punch data meets the punch threshold indicating that a pressure of the punch cylinder has reached a set or threshold pressure. The second component may comprise a cutter of the cutting assembly, the second set of data comprises the tensioning data, the second predetermined threshold comprises a tensioning threshold. The cutter may be released or activated when the tensioning data meets the tensioning threshold indicating that the band is tensioned. The one or more sensors may comprise a plurality of contact sensors disposed on or proximate a head of the banding tool. The plurality of contact sensors may generate one or more of the positioning data or the tensioning data.

The method may further comprise holding the band in tension for a first predetermined duration prior to releasing or activating the punch. The method may further comprise holding the band in tension for a second predetermined duration prior to releasing or activating the cutter. The method may further comprise communicating one or more of the positioning data, the punch data, the tangency data, the tensioning data, or a notification by at least one of audio or visual, the notification validating the tensioning procedure and locking procedure for the band.

In an embodiment according to the present disclosure, a method for determining at least one component characteristic may comprise receiving data from one or more sensors disposed on or in association with a banding tool. The banding tool may have a punch assembly and a cutting assembly. The data may have positioning data corresponding to a position of a buckle of a band, punch data corresponding to a pressure of a punch cylinder of the punch assembly, and tangency data corresponding to a position of a workpiece relative to the buckle. The method may also comprise determining a characteristic of the system based on the data. The method may also comprise determining a repair step for a component and/or a trend of a component based on the data, wherein a single data point or a trend indicating that the component is wearing and/or in need of adjustment or maintenance. The method may also comprise communicating a notification based on the repair step and/or the trend.

The notification may correspond to one or more of a component malfunction, a component breakage, or a component maintenance. The trend may be determined from a table constructed from the data depicting the trend numerically over a number of occurrences (e.g., a history of last number of cycles) or from a graph generated from the data over the number of occurrences and compared to a theoretical, idealized or predetermined data set. The data for the table or the graph may be updated for each component with each additional operation the tool. The characteristic may be one or more of tension, pressure, force, motor speed, torque, or duration. The trend may correspond to one or more of a drop in a velocity of a punch of the punch assembly over one or more of a number of occurrences, an increase in a motor speed and lack of reaching a target torque, or an increase in time for a pressure of the punch assembly to reach a target pressure. The drop in the velocity may indicate that a component of the punch assembly is malfunctioning, the increase in motor speed indicates that maintenance is required for a component of the motor, and the drop in the pressure indicates that an air flow rate or seal is malfunctioning. The method may further comprise analyzing the trend to determine a predictive maintenance step prior to malfunctioning of the component.

A system for determining a characteristic of a banding tool according to one embodiment of the present disclosure may comprise one or more sensors disposed on or in association with a banding tool; a processor; and a memory storing instructions for execution by the processor. The instructions, when executed, may cause the processor to: receive data from one or more sensors disposed on a banding tool, the banding tool having a punch assembly and a cutting assembly, the data having positioning data corresponding to a position of a buckle of a band, punch data corresponding to a pressure of a punch cylinder of the punch assembly, and tangency data corresponding to a position of a workpiece relative to the buckle, determine a characteristic of the system based on the data, determine a repair step for a banding process based on the characteristic, and communicate a notification based on the repair step.

The system may further comprise a user interface for displaying at least one of the data or the notification. The instructions, when executed, may cause the processor to determine a trend of a component based on the data, the trend indicating that the component is wearing, analyze the trend to determine a predictive maintenance step prior to malfunctioning, and communicate the predictive maintenance step. The trend may be determined from a table or a graph of the data.

DRAWINGS

The accompanying drawings, which are incorporated in and constitute a part of the specification, illustrate embodiments of the invention and together with the general description of the invention given above and the detailed description of the drawings given below, serve to explain the principles of these inventions. It should be understood, of course, that the invention is not necessarily limited to the particular embodiments illustrated herein.

DESCRIPTION

Figure 1A:
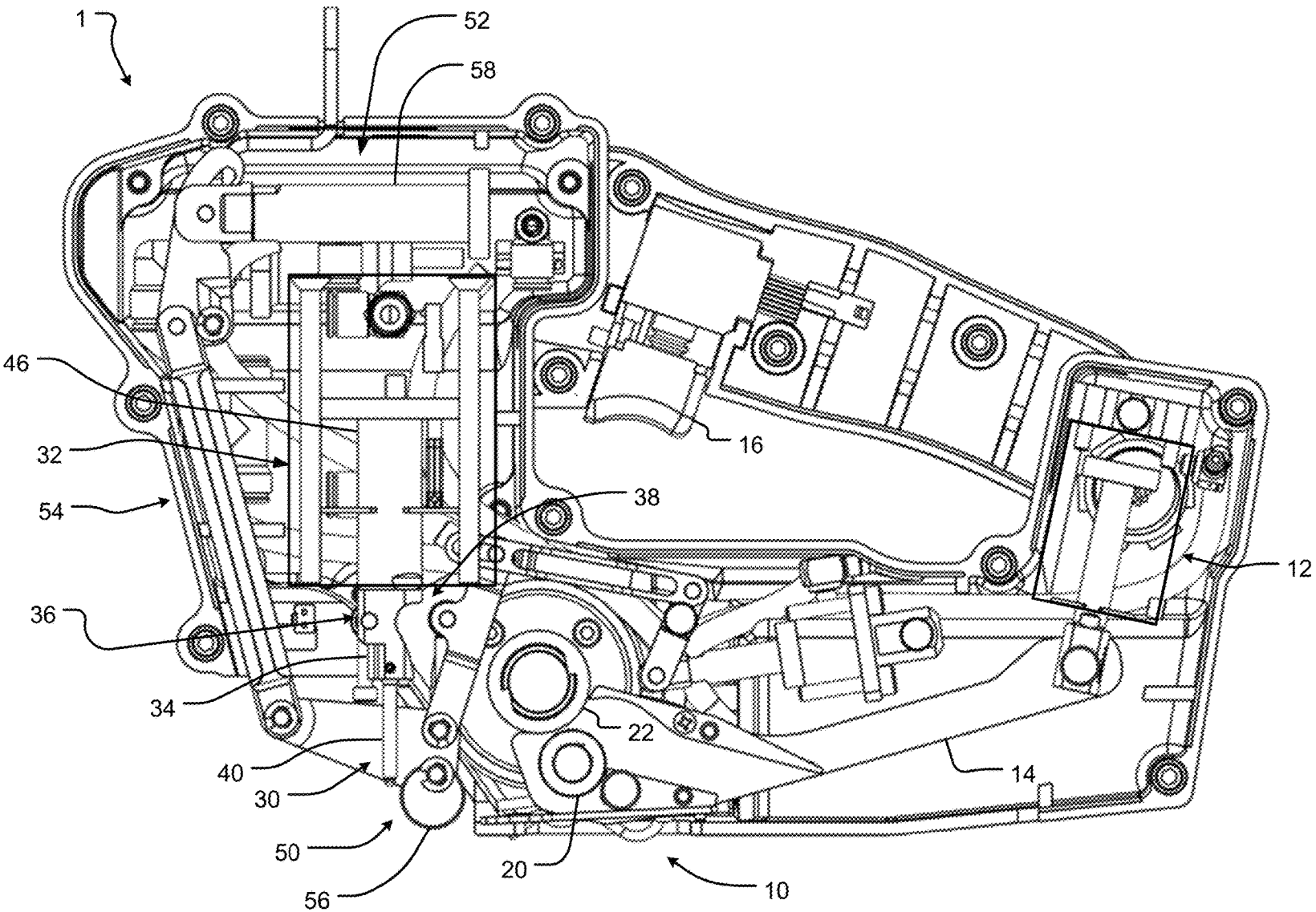
FIG. 1A is side view of a banding tool according to aspects of the present disclosure, with various components removed for clarity.
Figure 1B:
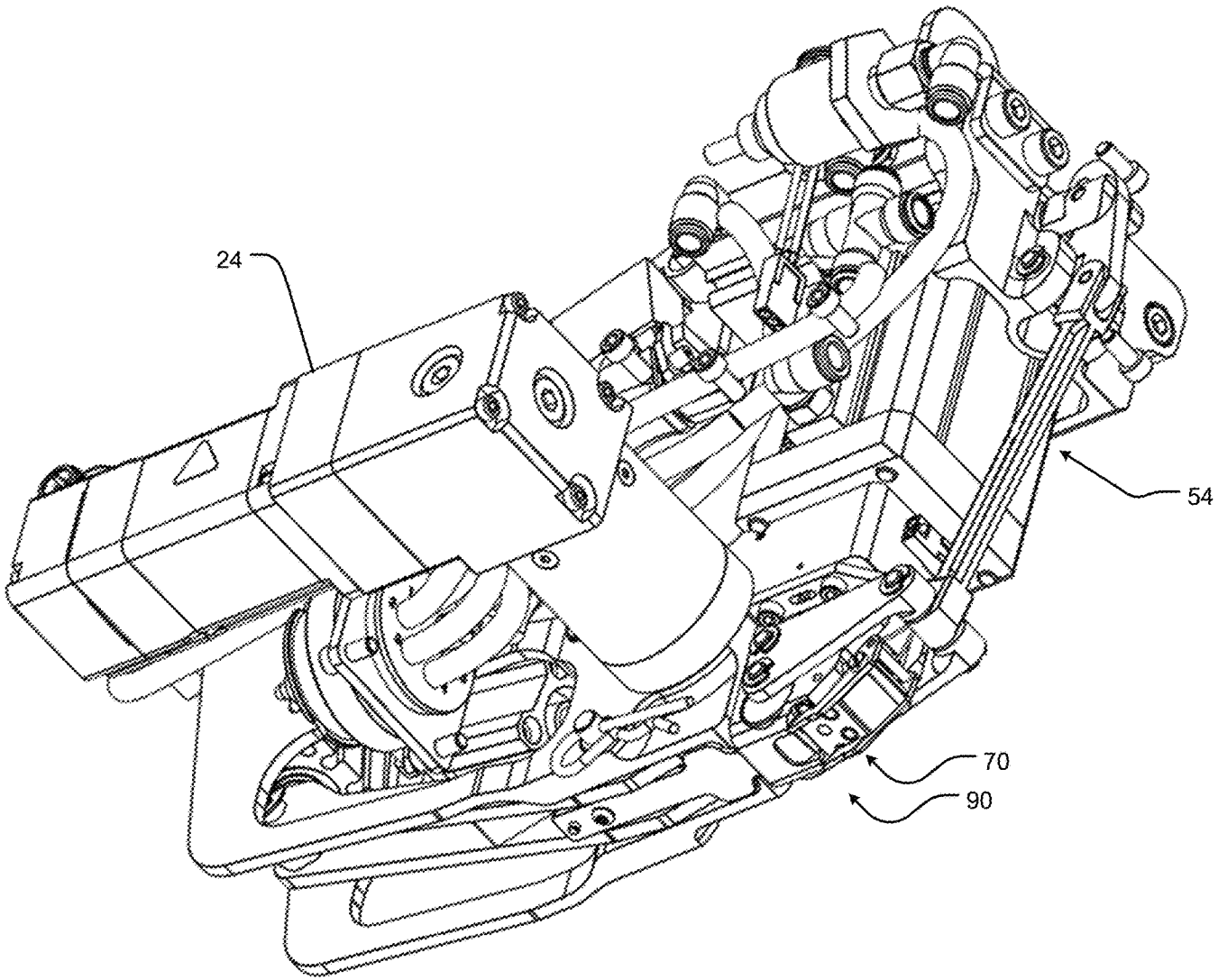
FIG. 1B is a bottom isometric view of the banding tool of FIG. 1A.

FIG. 1A illustrates a right-side view of a banding tool 1 according to aspects of the present disclosure with multiple components removed (such as covers and various sensor assemblies) for clarity. FIG. 1B illustrates an isometric bottom view of the tool 1 with multiple components remove (such as covers) for clarity. The banding tool 1 is configured to receive and tension a band 2 (shown in FIG. 3D) around a workpiece 4 (shown in FIGS. 4B, 4D, and 4E) using a band tensioning assembly 10, punch a buckle 6 (shown in FIGS. 3B and 3D) to secure the band 2 to the workpiece 4 using a punch assembly 30, and removing an excess tail from the band 2 using a cutting assembly 50. In some embodiments, the tool 1 uses pneumatic cylinders to operate each assembly 10, 30, 50. In other embodiments, the cylinders may be hydraulic.

Figure 3B:
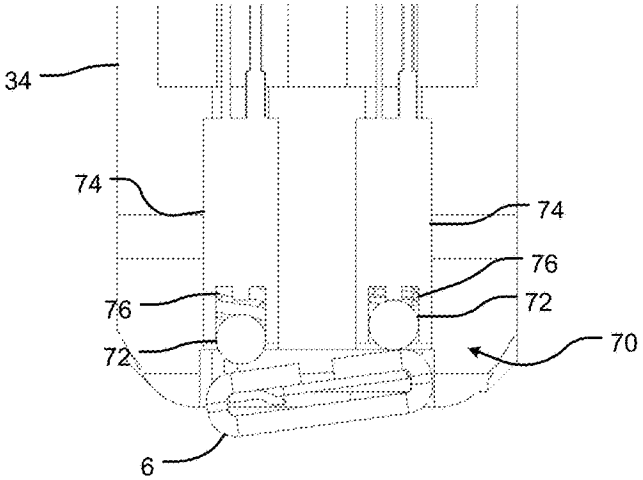
FIG. 3B is a cross-section view of the punch housing of FIG. 3A taken along line A-A of FIG. 3A with some components shown in transparency, and further showing a buckle and band.
Figure 4A:
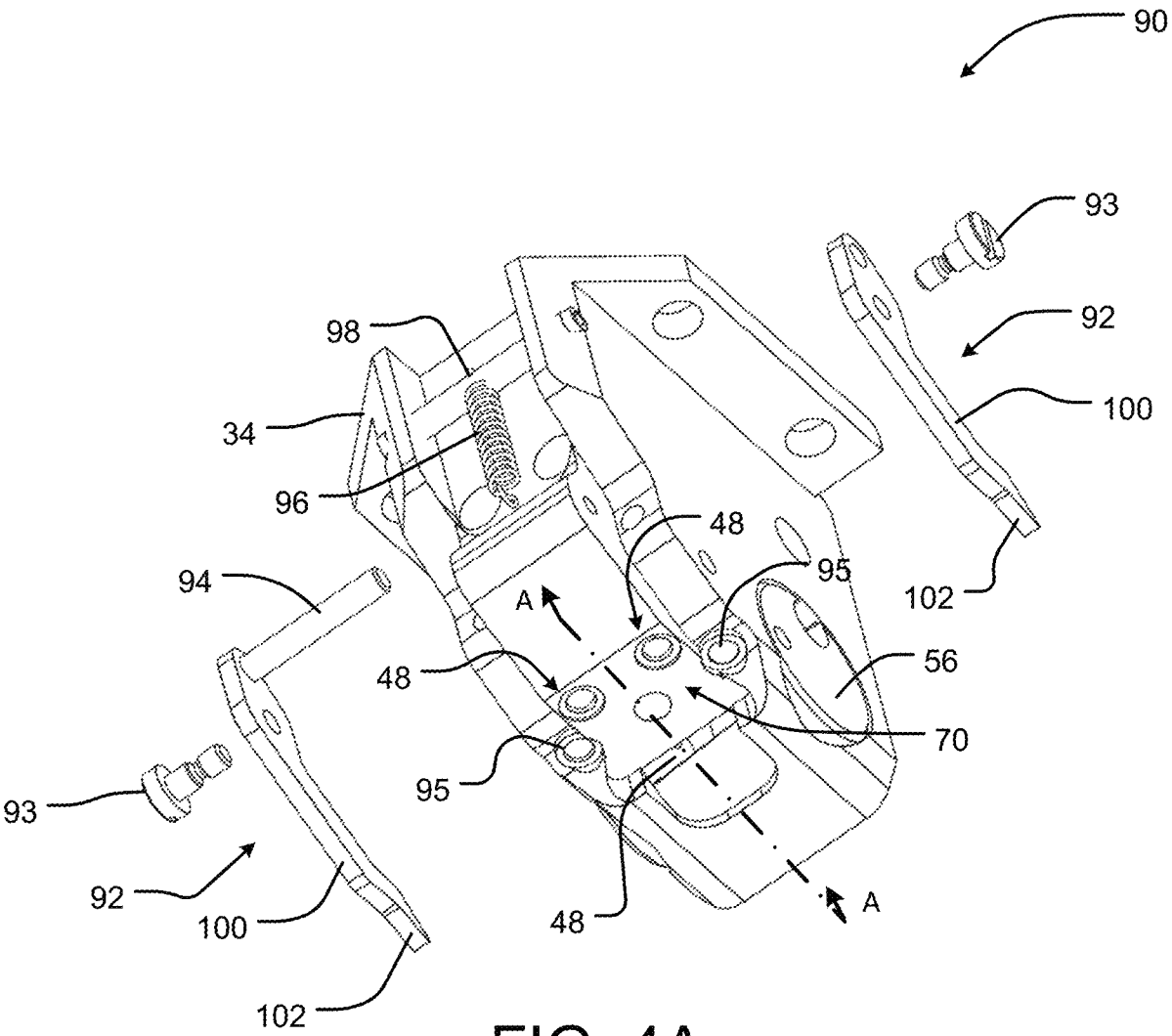
FIG. 4A is a bottom isometric, exploded view of the punch housing of the banding tool of FIG. 1A.
Figure 4B:
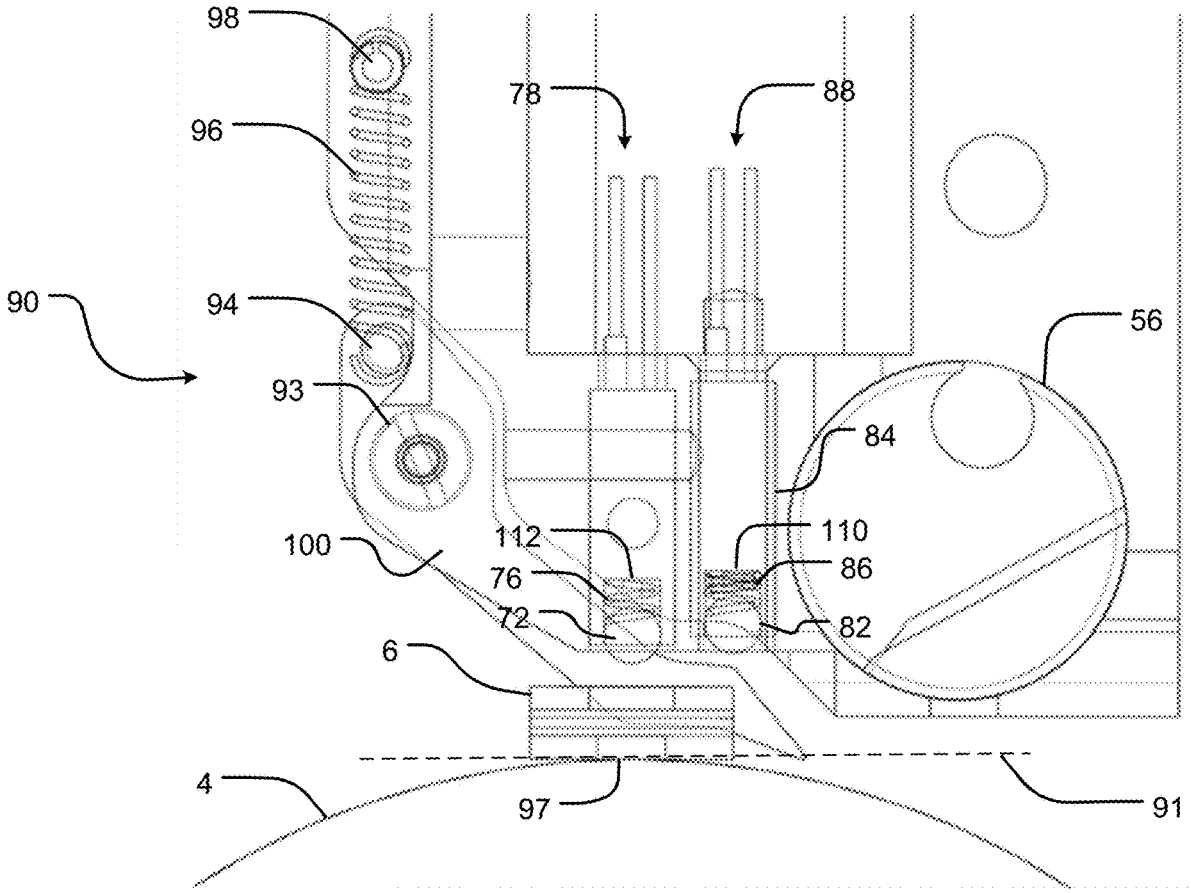
FIG. 4B is a cross-section view of the punch housing of FIG. 4A taken along line A-A of FIG. 4A with some components shown in transparency, and further showing a buckle and band and workpiece in a first position relative to the punch housing.
Figure 4D:
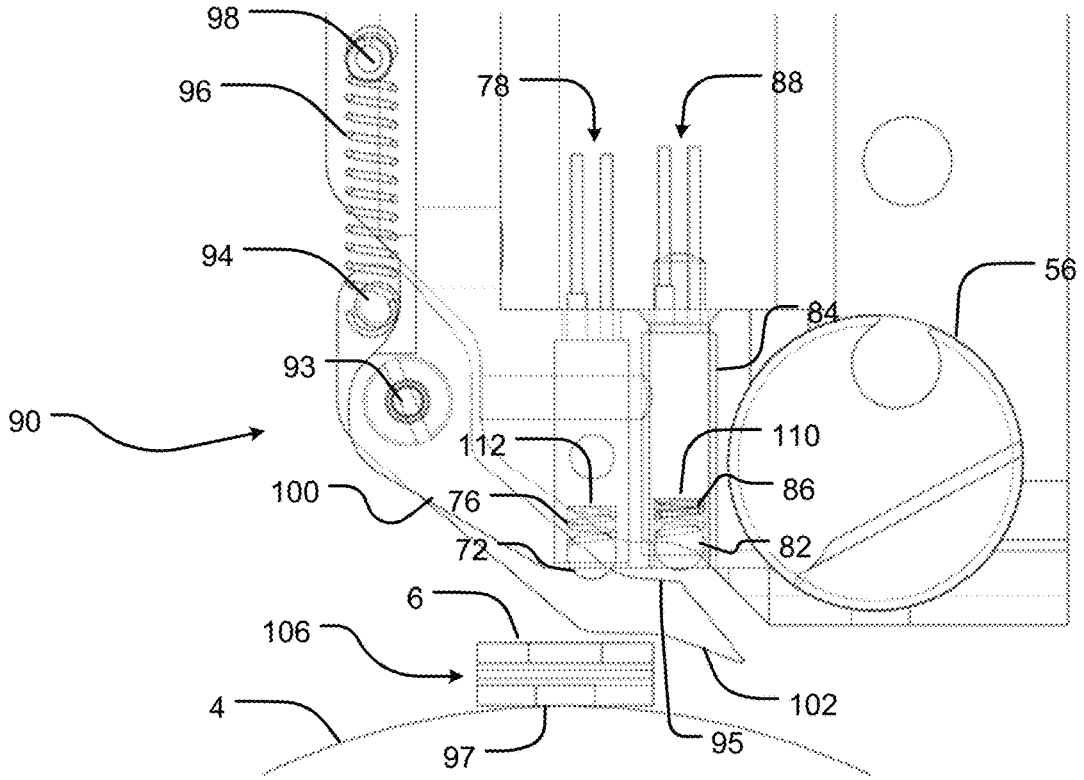
FIG. 4D is another cross-section view of the punch housing of FIG. 4A taken along line A-A of FIG. 4A with some components shown in transparency, and further showing a buckle and band and workpiece in a second position relative to the punch housing.
Figure 4E:
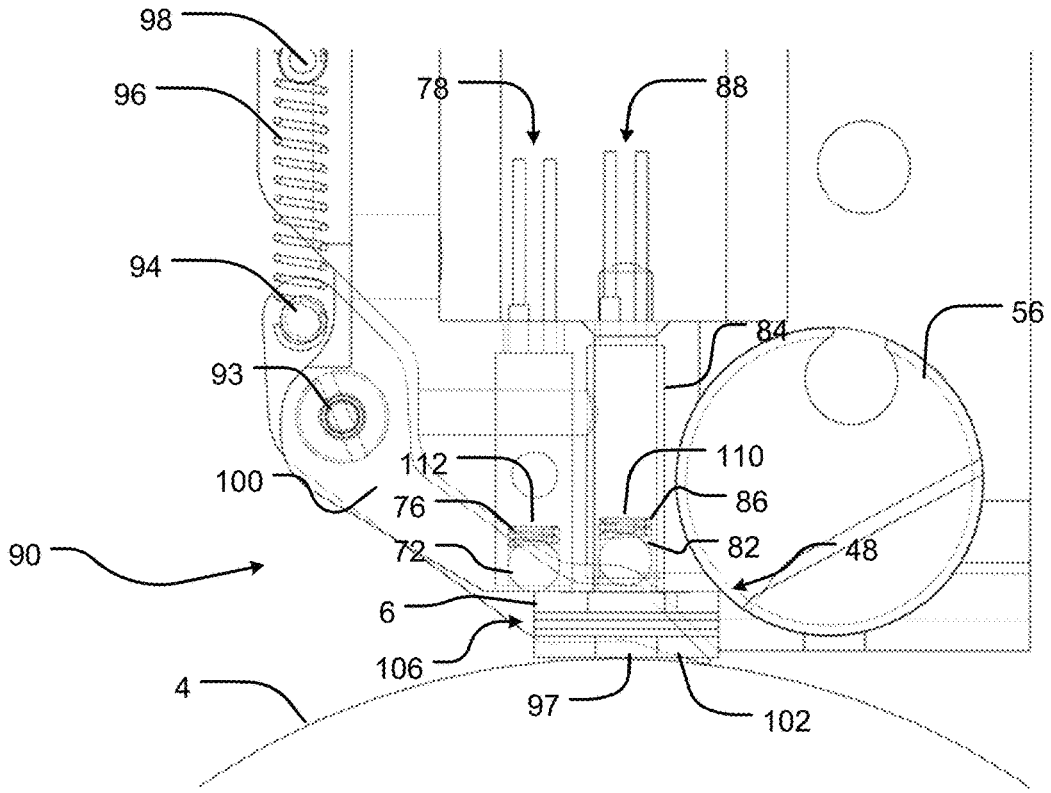
FIG. 4E is a further cross-section view of the punch housing of FIG. 4A taken along line A-A of FIG. 4A with some components shown in transparency, and further showing a buckle and band and workpiece in a third position relative to the punch housing.
Figure 5C:
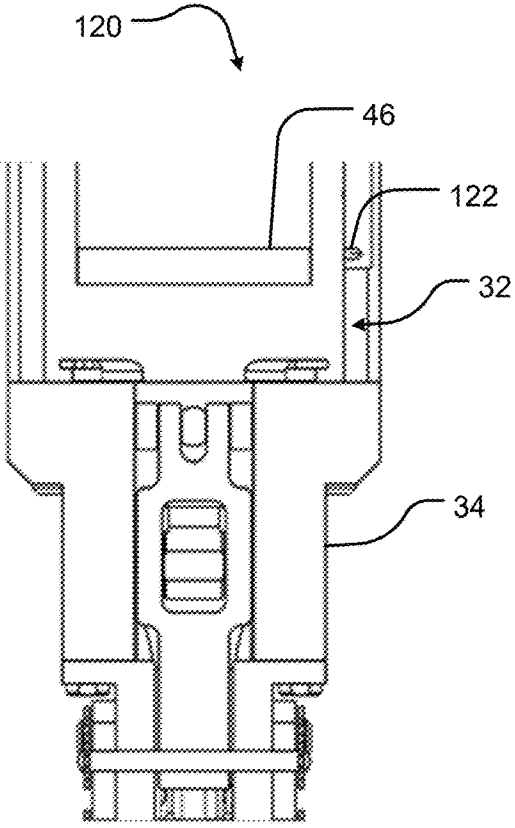
FIG. 5C is a further front view of the punch housing of FIG. 5A, with the piston cylinder in a third state.
Figure 5B:
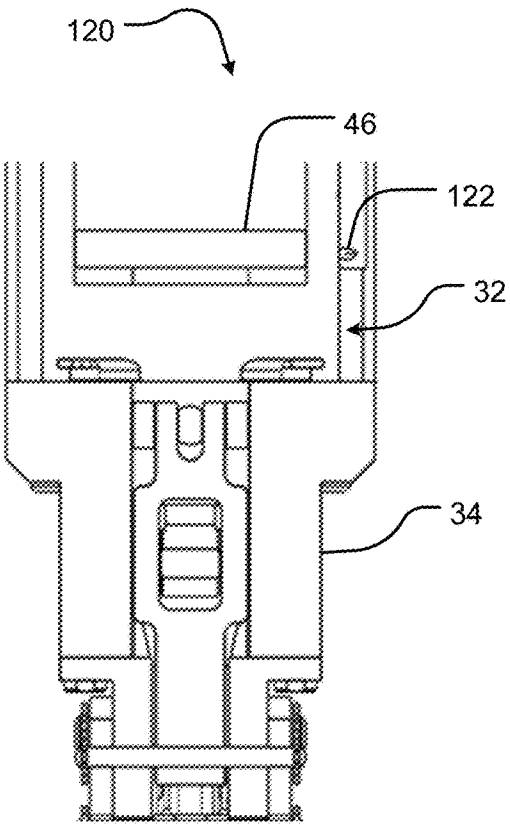
FIG. 5B is another front view of the punch housing of FIG. 5A, with the piston cylinder is a second state.
Figure 5A:
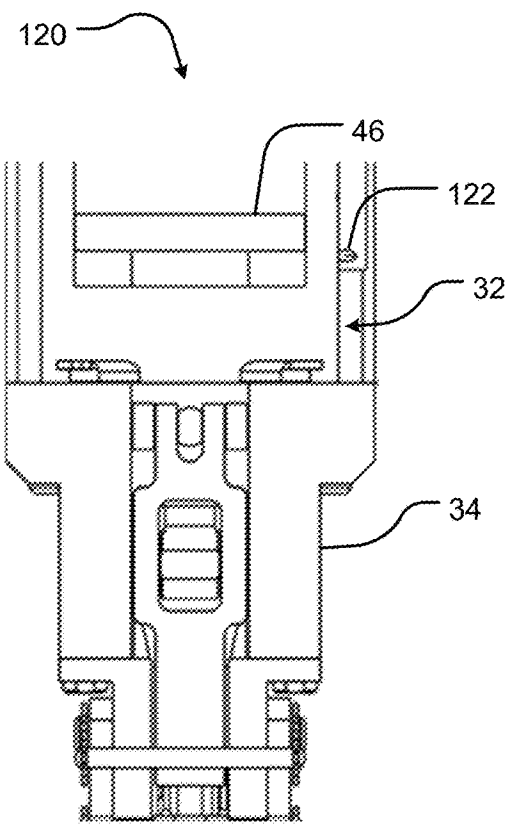
FIG. 5A is a front view of the punch housing of the banding tool of FIG. 1A, with the piston cylinder in a first state.

The tool 1 also includes a position sensor assembly 70 (visible in FIGS. 1B and 3A-3D), a tangency sensor assembly 90 (visible in FIGS. 1B, 4A-4B, and 4D-4E), and a velocity sensor assembly 120 (visible in FIGS. 5A-5C). The position sensor assembly 70 senses when the buckle 6 is correctly aligned within a tool head 3 (shown in FIG. 3D) and the tangency sensor assembly 90 senses when the buckle 6 is properly aligned to the workpiece 4 to ensure proper striking of the buckle 6 by the punch 40. The punch 40 is not released or activated until at least the position sensor assembly 70 and the tangency sensor assembly 90 senses that the buckle is properly positioned with respect to the punch 40 and the workpiece 4. The velocity sensor assembly 120 measures a velocity of a punch piston 46 to ensure that a proper punch velocity (and thus, striking force of the punch 40) was achieved.

The band tensioning assembly 10 includes a tensioning cylinder 12, a clamp lever 14, a pinch wheel 20, a tension drive wheel 22, and a motor 24. The tensioning cylinder 12 is configured to activate the clamp lever 14. When activated, the clamp lever 14 pivots to pinch a leading edge of the band 2 between the pinch wheel 20 and the tension drive wheel 22. The assembly 10 may further include a motor 24, shown in FIG. 1B. The motor 24 drives the tension drive wheel 22 to pull the band 2 into a tensioned state. In some embodiments, the motor 24 may drive either the pinch wheel 20, the tension drive wheel 22, or both the pinch wheel 20 and the tension drive wheel 22. In some embodiments, the pinch wheel 20 and/or the tension drive wheel 22 has a textured surface to facilitate frictionally engaging the band. The textured surface may include, but is not limited to, an etched surface, a surface resembling sandpaper, a surface resembling grip paper, or the like. In other embodiments only the pinch wheel 20 may be textured, only the tension drive wheel 22 may be textured, or neither the pinch wheel 20 nor the tension drive wheel 22 is textured. Alternatively, either the pinch wheel 20 or the drive wheel 22 or both may have a rubberized surface to facilitate gripping the band. The assembly 10 may also include a trigger 16. During use of the tool 1, activation of the trigger 16 by the operator activates the tensioning assembly 10. Conversely, release of the trigger 16 depressurizes the tensioning system and releases the band 2. The amount of tension may be set by an operator.

The punch assembly 30 comprises a punch cylinder 32, a punch housing 34, a punch driving linkage 36 (shown in FIG. 3A), a release mechanism 38, a punch 40, and the position sensor assembly 70. During use, the punch cylinder 32 accumulates pressure until the pressure reaches a threshold pressure. When the pressure meets the threshold pressure and, optionally, one or more other conditions are satisfied, the cylinder 32 drives the punch 40 into the band 2 and the buckle 6. More specifically, a punch piston 46 moves the driving linkage 36 which, in turn, drives the punch 40. Interior surfaces of the punch housing 34 stabilize and guide the reciprocal movement of the punch 40. As shown, and will be described in more detail below, the punch housing 34 is configured to also house or otherwise receive the positioning sensor assembly 70, the tangency sensor assembly 90, and the knife 56. The force applied by the punch may be set by an operator.

According to at least some embodiments of the present disclosure, prior to release of the punch cylinder 32 (and thus the punch 40), the release mechanism 38 blocks movement of the punch 40 until (1) the pressure meets the threshold pressure and a predetermined pressure is accumulated in the punch cylinder 32; (2) the position sensor assembly 70 senses a proper positioning of the band 2 and the buckle 2 relative to a head 3 (visible in FIG. 3D) of the tool 1; and/or (3) the tangency position sensor assembly 90 sense a proper positioning of the buckle 2 relative to the workpiece 4. In the illustrated embodiments, the release mechanism 38 includes a depression 42 on the punch housing 34 and a protrusion 44 on a release link 46. The depression 42 and the protrusion 44 are shaped to match each other such that the protrusion 44 is received in the depression 42. In the illustrated embodiment shown in FIG. 1, the depression 42 and the protrusion 44 are circular shaped. In other embodiments, the depression 42 and/or the protrusion may be any shape including, but not limited to, a square, triangular, rectangular, oval, or the like as will be appreciated by those of skill in the art upon review of this disclosure.

Turning to the cutting assembly 50, the assembly 50 comprises a cut cylinder 52, a cutting linkage 54 and a rotary knife 56. Following release of the punch 40, a system controller (such as a controller 204, shown in FIG. 6) activates the cutting assembly 50 to cause a leading portion of the band 2 to be severed and a cut edge of the band to be bent against the buckle. More specifically, a cut piston 58 moves the cutting linkage 54 which, in turn, drives the knife 56.

Turning to FIGS. 2A-2D, the cutting linkage 54 and components of the cutting linkage 54 are shown. The cutting linkage 54 includes a first linkage 60 pivotably coupled to a first end 62 of a bar linkage 64 via a first pivot point 55 and a second linkage 66 pivotably coupled to a second end 68 of the bar linkage 64 via a second pivot point 57. The second linkage 66 is pivotably coupled to the knife 56 via a third pivot point 59. Each of the first pivot point 55, the second pivot point 57, and/or the third pivot point 59 may include a rod, a screw, a pin, or the like received in a corresponding aperture of the first linkage 60, the bar linkage 64, and/or the second linkage 66.

The first linkage 60 includes a slot 51 for receiving a pin 53 of the cut piston 58. As the cut piston 58 moves, the pin 53 pushes against the slot 51, which moves the first linkage 60 along a profile of the slot 51. In some embodiments the slot 51 has an involute curve profile, shown in detail in FIG. 2B. In other embodiments, the slot 51 may have any profile. The involute curve profile may maximize an efficiency of force transferred between the cut piston 58 and the first linkage 60. The involute profile may be created using, for example, parametric equations such as ¬x_t=r(cos(t)+t sin (t)), y_t=r(sin(t)−t cos(t))) to relate the motion of the cut piston 58 and the first linkage 60.

Figure 2B:
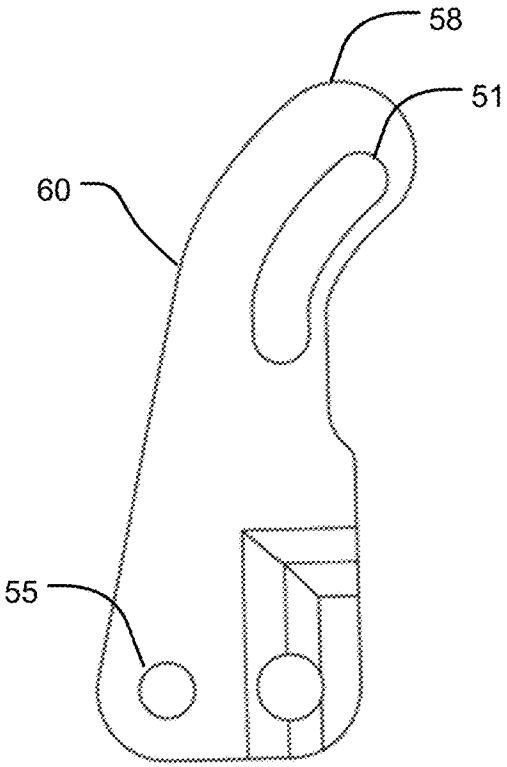
FIG. 2B is a side view of a first linkage of the cutting linkage of FIG. 2A.
Figure 2A:
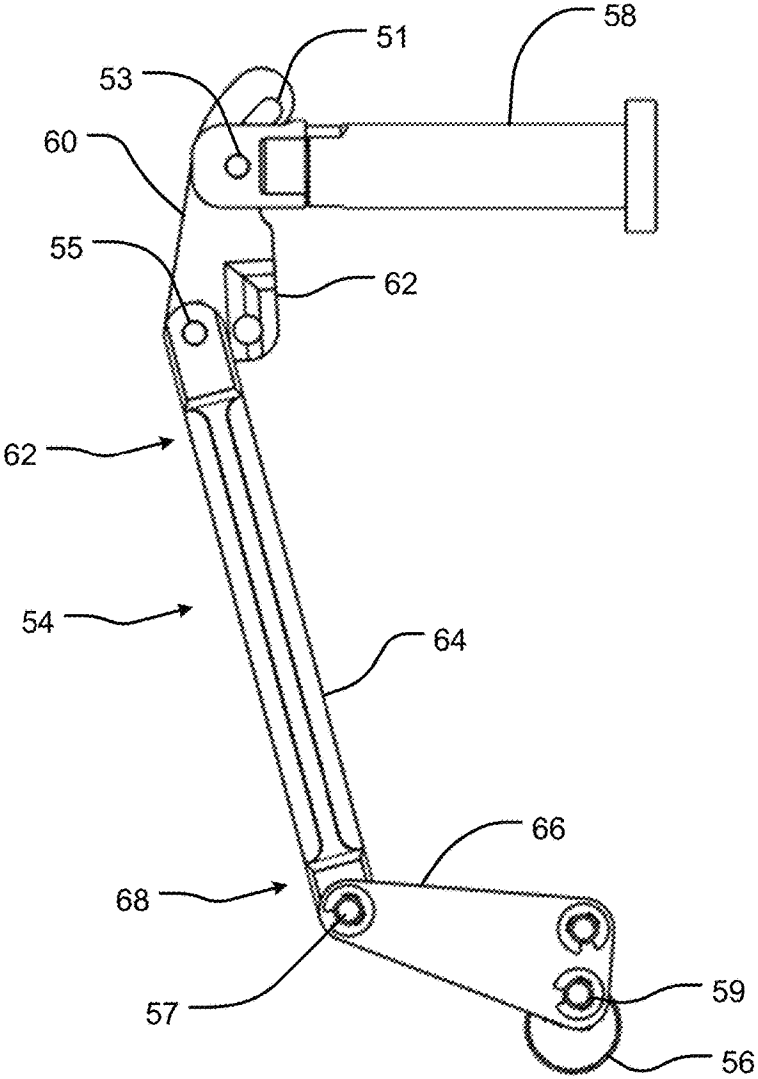
FIG. 2A is a side view of a cutting linkage of the banding tool of FIG. 1A.
Figure 2D:
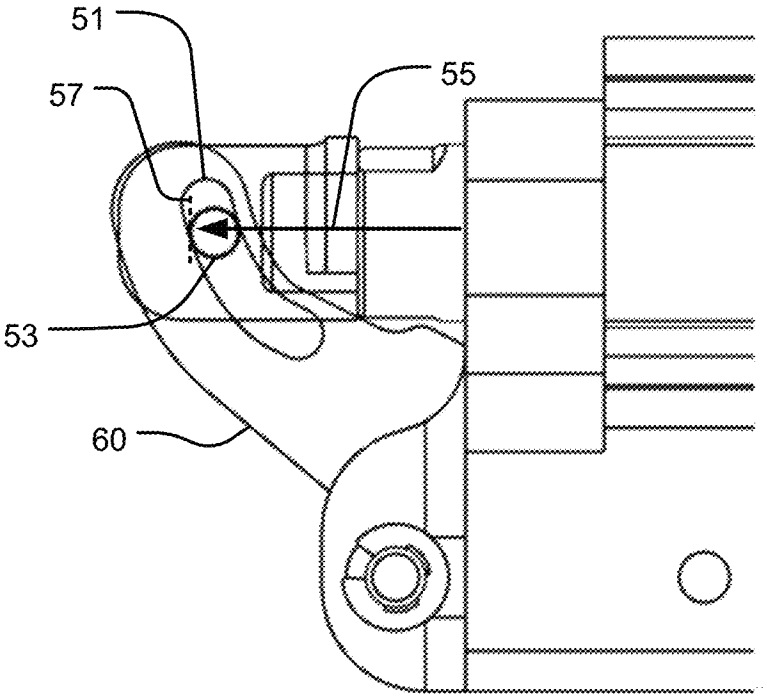
FIG. 2D is a side view of a portion of the first linkage of FIG. 2A in a second position.
Figure 2C:
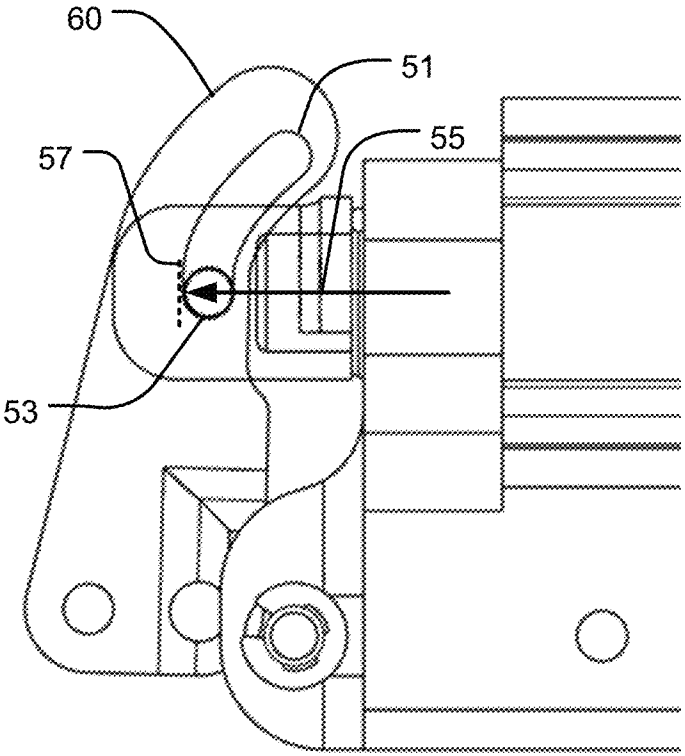
FIG. 2C is a side view of a portion of the first linkage of FIG. 2A in a first position.

As shown in FIGS. 2C-2D, by utilizing an involute profile, an applied force of the cut piston 58 can be maintained through the entire stroke through perpendicularity with a contact surface (represented by a dashed line 57) and the line of action of the applied force (represented by an arrow 55). In other words, as the pin 53 of the cut piston 58 pushes against the slot 51, the first linkage 60 rotates in such a way as to maintain perpendicularity of the contact surface of the slot 51 to the pin 53. The involute profile of the slot 51 beneficially reduces an overall size of the tool 1 as the first linkage 60 can rotate in a space smaller than a space required for rotation of a first linkage directly pinned to the cut piston 58. The involute profile of the slot 51 also beneficially provides enough force transfer from the cut piston 58 to the knife 56 via the cutting linkage 54 while reducing the size of the tool 1.

It should be appreciated that the illustrated tensioning assembly 10, punch assembly 30 and cutting assembly 50 described above are exemplary. Other methods and component parts may be used to accomplish the functions of tensioning a band, driving a punch, and cutting a free end of a band to secure a band to a workpiece, as is known to those of skill in the art. Such other methods and components are within the spirit and scope of the present disclosure. Also, a controller 204, shown in FIG. 6, coordinates the sequencing of the various systems and monitors information received from the position sensor assembly 70, the tangency sensor assembly 90, the velocity sensor assembly 120, and/or other additional system sensors. Target sensor thresholds may be predetermined and set by a system operator depending upon the type and style of band and buckle being installed. For example, overall system pressure and individual subassembly cylinder pressures may be varied and monitored. Similarly, the torque applied by the motor 24 may be varied and monitored. The position sensor assembly 70, the tangency sensor assembly 90, and the velocity sensor assembly 120 will now be described in detail.

To help illustrate use of the sensor assemblies 70, 90, 120 (and the tensioning assembly 10, the punch assembly 30, and the cutting assembly 50, as described above), a band clamping process will be described according to one embodiment of the present disclosure. The band clamping starts with the operator inserting the free end of a pre-formed band 2 into the buckle 6 located in the tool head 3. The clamp cylinder 12 actuates the clamp lever 14 which results in clamping the band 2 between the pinch wheel 20 and the tension drive wheel 22. The motor 24 rotates at least the tension wheel 22 to pull the leading portion of the band 2 relative to the buckle 6 and increasing the tension in the band 2. When the band reaches a predefined tension value, which may be measured with a tension load cell in contact with the buckle 6 or by measuring torque on the motor 24 (or both) or by other methods known to those of skill in the art, the motor stops pulling on the band lead portion. Assuming a threshold level of pressure is present within the punch cylinder 32, the controller activates the punch cylinder 32. However, the punch 40 may be temporarily blocked from release by the release mechanism 38 if the position sensor assembly 70 and the tangency sensor assembly 90 do not indicate that the buckle 6 is properly positioned with respect to the punch 40 and the work piece 4. If the punch 40 is not blocked from release, a velocity of the punch piston 46 may be measured to ensure that enough force was exerted onto the band 2 to deform the band 2 to the buckle 6.

Various issues may arise during the banding process such as misalignment of the buckle in the tool head 3, lack of tangency between the buckle 6 and the workpiece 4, and/or problems related to the punch 40. Sensors disposed on or in association with the tool 1 are utilized to both detect these issues, and also provide data for short and/or long-term monitoring and analysis.

Figure 3A:
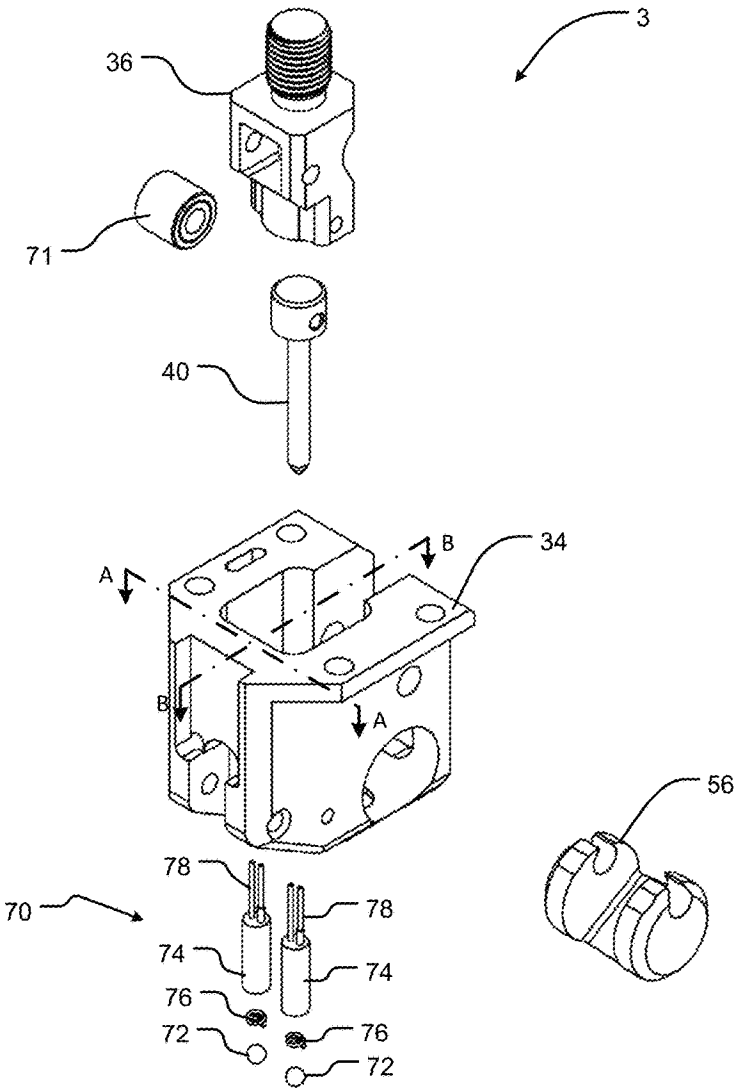
FIG. 3A is an isometric exploded view of a punch housing of the banding tool of FIG. 1A.

Turning to FIG. 3A, an exploded view of a portion of the tool head 3 including the position sensor assembly 70, the knife 56, and the punch 40 is shown. After the band 2 reaches a predefined tension, the band 2 is locked in that position. As previously mentioned, the position sensor assembly 70 detects misalignment of the buckle 6 in the tool head 3. Misalignment of the buckle 6 in the tool head 3 may result in the punch 40 striking the buckle 6 in the wrong position. Misalignment of the buckle 6 may also result in the 40 striking the buckle 6 at a non-perpendicular angle, which may cause insufficient deformation of the buckle 6. Either scenario can result in a band that does not achieve its targeted retained force.

In the illustrated embodiment, two position sensors 42 are shown. In other embodiments, one position sensor or more than two position sensors may be used. The two position sensors 42 are positioned on opposite sides of the punch 40 and housed in the punch housing 34. This positioning ensures that both sides of the buckle 6 are aligned with a shoulder 48 (shown in FIG. 3D) of the tool head 3 when both position sensors 42 are activated. More specifically, the positioning ensures that a top surface of the buckle 6 is flush with a top surface 65 of the shoulder 48, thus ensuring that the buckle 6 is perpendicular to the punch 40.

Position sensors 42 of the position sensor assembly 70 each have a position contact 72 housed at an end of a position housing 74 such that the position contact 72 faces and is contacted by the buckle 6. In the illustrated embodiment, the position housing 74 is cylindrical with a cylindrical bore. In other embodiments, the position housing 74 may be a protrusion of any shape including, but not limited to, a rectangle, a square, an oval or the like. The position housing 74 may also have a bore of any shape including, but not limited to, a rectangle, a square, an oval or the like. The bore of the position housing 74 may be the same shape as the position housing 74 or may have a different shape as the sensor housing.

In the illustrated embodiment, the position contact 72 is a spherical contact bearing. In other embodiments, the position contact 72 may be any shape including, but not limited to, a square, a rectangle, an oval, a diamond or any other shape know to those of skill in the art. The position contact 72 is mounted in an outwardly biased. In the illustrated embodiment, the bias is provided by a spring 76. The position sensor assembly 70 also includes position electronic leads 78. The position electronic leads 78 may connect each positions sensors 42 to a memory (such as memory 214 shown in FIG. 6) for storing position sensor data, a processor (such as processor 208 shown in FIG. 6) for processing the position sensor data, and/or a transmitter for transmitting signals to a controller (such as controller 204 shown in FIG. 60.

In operation, when the position contacts 72 are biased outwardly, no signal is sent to a controller 204. Optionally, the controller may output a signal that may be received by a user interface (such as user interface 218 shown in FIG. 6) and communicated (visual and/or audible) to a user that the buckle 6 and band 2 are not properly aligned. When the position contacts 72 are pressed into the position housing 74, the springs 76 are compressed and contact is made between the contacts 72 and/or the springs 76 and electrical contacts 112 (shown in FIGS. 4D and 4E) within the position housing 74. This results in a signal being sent to the controller 204 indicative of the correct position of the buckle 6 relative to the shoulder 48. The controller 204 then may optionally provide an output to the operator indicative of the correct position and will cause the release mechanism 38 to be withdrawn so that the punch 40 may be released. As previously described, the punch 40 is driven by the punch driving linkage 36 interconnected with the punch 40 and with the punch cylinder piston 46. A roller 71 maintains alignment and guides the motion of the driving linkage 36 relative to interior surfaces of the punch housing 34. The driving linkage 36, in turn, drives the punch 40 into the buckle 6 and band 2.

In other embodiments, the operator may be required to depress the trigger to release the punch. Here, the release mechanism 38 may be positioned relative to the trigger 16 and prevent a user from depressing the trigger 16 until the buckle 6 is aligned with the tool head 3. In other words, the user may not operate the tool 1 until the buckle 6 is aligned with the tool head 3. In further embodiments (for example, if a tool 1 does not include a release mechanism 38 or in addition to user of the release mechanism 38), when the position contacts 72 are biased outwardly (or not depressed), the controller 204 may cause the tool 1 to cease operation, whether by sending a signal to a controller 204 of the punch assembly 30 to prevent the punch cylinder 32 from actuating, or preventing operation of the tool 1 in any way.

Figure 3D:
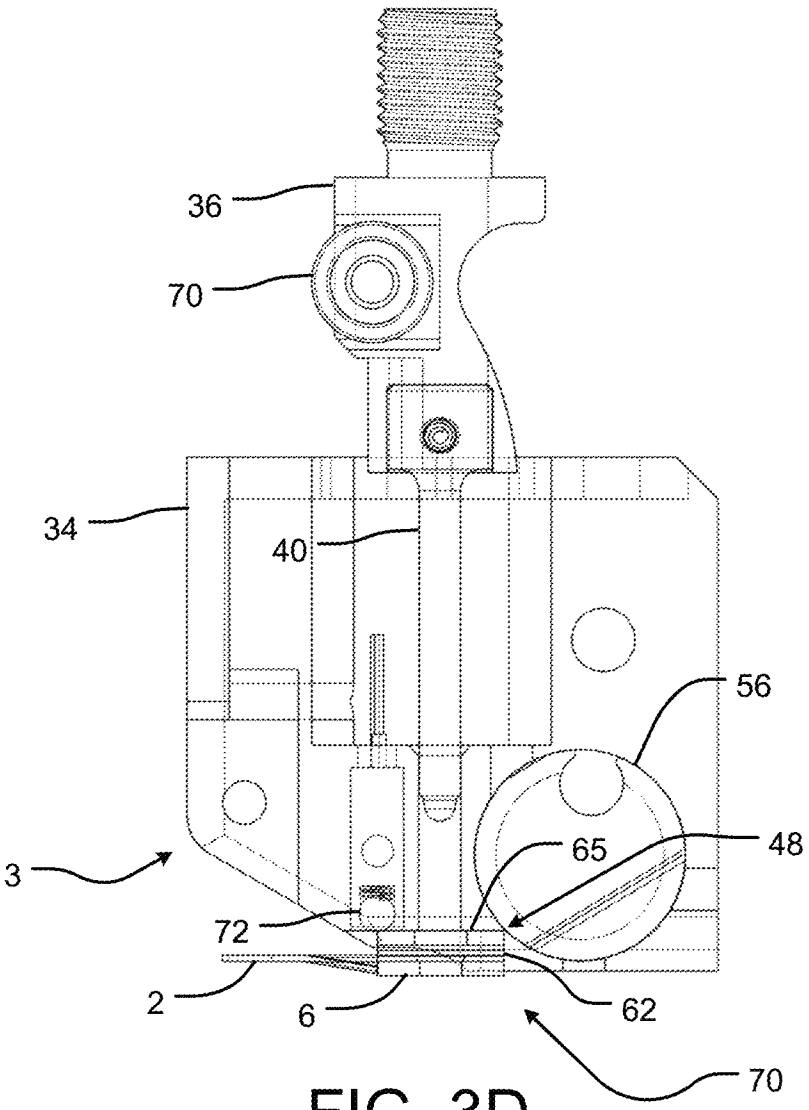
FIG. 3D is a cross-section view of the punch housing of FIG. 3A taken along line B-B of FIG. 3A with some components shown in transparency, and further showing a buckle and band.
Figure 3C:
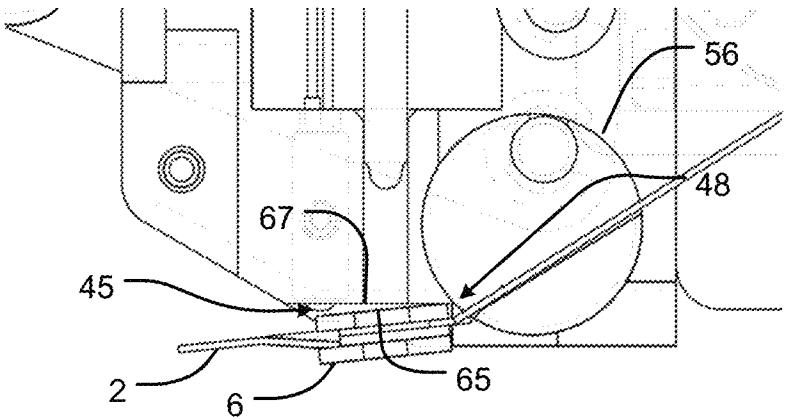
FIG. 3C is a cross-section view of the punch housing of FIG. 3A taken along line B-B of FIG. 3A with some components shown in transparency, and further showing a buckle and band.

Turning to FIGS. 3B, 3C, and 3D, a front side view, a right-side view, and another right-side view, respectively of the position sensor assembly 70 during use is shown. The buckle 6 is shown in FIGS. 3B-3D and the band 2 is shown in FIGS. 3C and 3D. As previously described, when the position sensors 42 are not in contact with the buckle 6, the release mechanism 38 remains in place and blocks activation of the punch 40. Generally, during operation the buckle 6 is initially pressed against a front surface 62 of the shoulder 48 of the tool head 3. The front surface 62 is perpendicular to the top surface 65. The tool 1 is then pivoted counterclockwise relative to the buckle 6 to remove a gap between a top surface of the buckle 6 and an upper surface 67 of the shoulder 48 and to bring the buckle 6 into contact with the position contacts 72 (and thus flush with the top surface 65). However, the buckle 6 may become misaligned with the tool head 3 and/or the punch 40 during this movement. As shown in FIG. 3B, the buckle 6 has a first contact 72 depressed, but does not have a second contact 72 depressed. Thus, the buckle 6 is not yet properly aligned and if the punch 40 were to be released, the buckle 6 would not be perpendicular to the punch 40 strike. This may lead to inadequate deformation of the buckle 6 and thus, result in a lower strength of the buckle 6 compared to a properly deformed buckle 6.

As is appreciated, as the band 2 is tightened, a space or gap 45, shown in FIG. 3C, between the tool 1 and the workpiece 4 will decrease. When the buckle 6 is properly aligned with the tool head 3 and the shoulder 48, as shown in FIG. 3D, and the position sensors 42 sense a correct position of the buckle 6, a feedback signal from the position sensors 42 to the controller 204 causes the release mechanism 38 to withdraw and freeing the punch 40 to be driven into the buckle 6 and band 2. In the illustrated embodiment, both position sensors 42 are activated before releasing the release mechanism 38 and allowing the punch 40 to be driven into the buckle 6 and band 2. In other embodiments, any predetermined number of position sensors may be required to be activated prior to releasing the release mechanism 38. For example, only four out of five position sensors 42 may need to be activated prior to releasing the release mechanism 38.

In some embodiments, the position sensor assembly 70 may include a load cell configured to measure a magnitude of force exerted on the buckle 6. The load cell may be positioned proximate the shoulder 48 such that the buckle 6 will engage the load cell when positioned. When the band 2 is tightened, the force is transferred through the buckle 6 into the load cell. Output from the load cell and the position sensors 42 may be used to calculate a time bracket in which the punch and cut operations are activated to complete the banding process.

Utilizing position sensors 42 reduces negative operator influence over the installation process. The position sensors 42 will ensure the buckle 4 is in the correct position before the punch 40 is activated. In addition, it should be appreciated that position sensors 42 are only one manner of detecting the position of the buckle 4 relative to the tool head 3. Other known sensing methods and apparatus may be used. These include proximity sensors, including Inductive, capacitive, photoelectric and ultrasonic types.

Turning to FIGS. 4A and 4B, a partially exploded view and a side view, respectively, of the tangency sensor assembly 90 is shown. The tangency sensor assembly 90 is configured to sense a lack of tangency between the buckle 6 and the workpiece 4 by sensing a correct positioning of the workpiece 4 relative to the buckle 6. In other words, the tangency sensor assembly 90 senses if the buckle 6 is properly positioned tangent to the workpiece 4. Combined with confirmation from the position sensor assembly 70 that the buckle 6 is in the correct position, confirmation from the tangency sensor assembly 90 confirms that the workpiece 4 is in the correct position relative to the buckle 4. As illustrated in FIG. 4B for clarity, the tangency is measured relative to a tangency line 91, shown as a dotted line. The lack of tangency occurs when a bottom surface 97 of the buckle 6 is not oriented on the tangency line 91. During operation, the bottom surface 97 of the buckle 6 should remain on the tangency line 91. If the bottom surface 97 of the buckle 6 is not aligned with the tangency line, and thus not tangent to the workpiece 4, then the band 2 and the buckle 4 may be improperly tensioned and installed. This may result in a reduced retained force of the clamped band 2. It should be appreciated that the tangency sensor assembly 90 may operate independent of the position sensor assembly 70.

As illustrated, the tangency sensor assembly 90 includes tangency sensors 92 comprising a tangency contact 82 and a corresponding tangency contactor arm 100. During operation, the tangency sensor 92 is activated when the tangency contactor surface 95 of arm 100 contacts and pushes against the tangency contact 82 to depress the tangency contact 82 until contact is made with the contact 110, shown in FIGS. 4D and 4E.

In the illustrated embodiment, two tangency sensors 92 are shown. In other embodiments, one tangency sensor or more than two tangency sensors may be used. The two tangency sensors 92 are positioned on opposite sides of the punch 40 and the position sensor assembly 70. The tangency contacts 82 are positioned in the punch housing 34 and the tangency contactor arms 100 are pivotably coupled to the punch housing 34. As illustrated, the tangency contactor arms 100 are each coupled to the punch housing 34 by a screw 93. In other embodiments, the tangency contactor arms 100 may be coupled to the punch housing 34 by a pin, a rod, a bolt, or the like. This positioning ensures that the tangency of the buckle 6 relative to the workpiece 4 is assessed on both sides of the buckle 6 and is satisfied when both tangency sensors 92 are activated. More specifically, the positioning ensures that the bottom surface 97 of the buckle 6 remains on the tangency line 91, thus ensuring that the buckle 6 is tangent to the workpiece 4.

As shown in FIG. 4B and similar to the position contacts 72, the tangency contacts 82 are each mounted in a tangency housing 84. In the illustrated embodiment, the tangency housing 84 is cylindrical with a cylindrical bore. In other embodiments, the tangency housing 84 may be of any shape including, but not limited to, rectangular, square, oval or other shape as will be understood by those of skill in the art upon review of this disclosure. The tangency housing 84 may also have a bore of any shape including, but not limited to, a rectangular bore, a square bore, an oval bore or any other shape bore as will be understood by those of skill in the art upon review of this disclosure. The bore of the tangency housing 84 may be the same shape as the sensor housing 74 or may have a different shape as the sensor housing 74.

In the illustrated embodiment, the tangency contact 82 is a spherical contact bearing. In other embodiments, the tangency contact 82 may be any shape including, but not limited to, a square, a rectangle, a cylinder, an oval, a diamond or any other shape as will be understood by those of skill in the art upon review of this disclosure. The tangency contact 82 is mounted in an outwardly biased. In the illustrated embodiment, the bias is provided by a spring 86. The tangency sensor assembly 90 also includes tangency electronic leads 88. The tangency electronic leads 88 may connect each tangency sensor 92 to a memory (such as memory 214 shown in FIG. 6) for storing position sensor data, a processor (such as processor 208 shown in FIG. 6) for processing the position sensor data, and/or a transmitter for transmitting signals to a controller (such as controller 204 shown in FIG. 6).

The tangency contactor arms 100 are interconnected by a first pin 94. The first pin 94 is spaced in a first direction from a pivot point defined by the screws 93. A biasing tension spring 96 extends between the first pin 94 and a second pin 98. The second pin 98 is also connected to the punch housing 34. The tension spring 96 biases the contactor arms 100 away from the tangency contact 82. The tangency contactor arms 100 extend from the pivot point in a direction generally opposite that of the first pin 94. The distal end of the arm 100 includes an outer surface 102 configured to engage a workpiece and in inner surface 95 configured to engage the tangency contact 82. As shown in FIG. 4B, the outer surface 102 is shaped to receive a surface of the workpiece 4 when the workpiece 4 is properly positioned with respect to the buckle 6, which then pivots the arm 100 to the tangency contact 82. When the workpiece 4 is moved into position, the arm 100 receiving or engaging the workpiece 4 is pushed against the bias of the spring 96 to move the contact surface 95 of the arm 100 to the tangency contact 82, then pushes against the bias of spring 86 to activate the tangency sensor 92. It should be appreciated that the workpiece may be brought to the tool or the tool may be moved into position relative to the workpiece.

The tangency arms 100 can be adjusted for different workpiece diameters. For example, the tangency arms 100 maybe adjusted through adjustment of a set screw. Additionally, the tangency arms 100 can be exchanged for arms having different shapes or configurations to accommodate differently shaped workpieces rather than adjusting the position of the arms 100. In the illustrated embodiment, the arms 100 are optimally used with workpieces generally having a 2.5-inch cylindrical diameter up to flat surfaces (effectively infinite diameters).

Figure 4C:
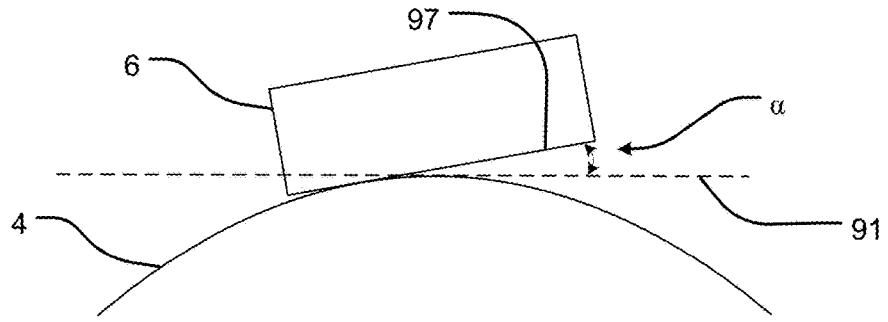
FIG. 4C is a schematic diagram of a buckle and a workpiece and the buckle offset from a tangency line.

As illustrated in FIG. 4C, in one embodiment, an accepted range for an angle of deviation (angle α) between a tangency line (e.g., tangency line 91) measured at the centerline of the buckle 6 and the workpiece 4 and the bottom surface 97 of the buckle may be predetermined. In some embodiments, the angle of deviation is 0 degrees to 7 degrees. In other embodiments, the angle of deviation is 0 degrees to 5 degrees. In further embodiments, the angle of deviation is 0 degrees to 2.5 degrees. The range of acceptability for the angle of deviation increases as the diameter of the workpiece 4 increases because the local area of curvature becomes less pronounced. For instance, a 2.5" diameter workpiece 4 with a deviation angle of 5 degrees would have a raised buckle 6 height of 0.058" from the workpiece at the trailing edge of the buckle 6, while a flat workpiece 4 would only have a 0.027" raised buckle 6 height at 5 degrees measured at the trailing edge of the buckle 6. In terms of raised height between the workpiece and the trailing edge of the buckle 6, the maximum allowable height is approximately 0.07 inches. The measurements will vary with differently sized and shaped buckles 6.

FIGS. 4D and 4E illustrate operation of the tangency sensor assembly 90. In FIG. 4D, the buckle 6 is positioned relative to the workpiece 4 such that the bottom surface 97 of the buckle 6 is oriented on a line tangent with the workpiece 4 (as shown in FIG. 4B), with a centerline of the buckle 6, defined between the leading and trailing edges of the buckle 6, generally aligned with the point of tangency. The band 2 is not shown for clarity purposes but would be wrapped around the workpiece 4 and threaded through a central channel 106 of the buckle 6 that extends from the leading edge to the trailing edge. When the buckle 6 is nested in the shoulder 48 of the punch housing 34, the two tangency arms 100 will straddle opposite sides of the buckle 6. The tangency arms 100 are biased outwardly, away from the punch head 34 by action of the corresponding spring 86.

In FIG. 4E, the buckle 6 is properly nested in the shoulder 48 of the punch housing 34 and the outer surface 102 of the distal ends of the tangency arms 100 has engaged the workpiece 4. The tangency arms 100 have moved closer to the punch housing 34 compared to FIG. 4D and against the bias of each corresponding spring 86. In addition, the inner surface 104 of the tangency arms 100 has depressed the tangency contact 82 causing it to engage contact 110 and the upper surface of the buckle 6 has depressed the position contact 72 to engage contact 112. As a result, electrical signals are sent by the position sensors 42 and tangency sensors 92 to a controller (such as controller 204 of FIG. 6) via their respective position electronic leads 78 and tangency electronic leads 88 indicative of the correct positioning of the buckle 6 with respect to the punch 40 and with respect to the workpiece 4, which, in turn, causes the controller to release the punch 40 if both the position sensors 42 and the tangency sensors 92 are activated.

Turning to FIGS. 5A-5C, a front elevation view of the punch piston 46 as it moves past the velocity sensor assembly 120 is shown. In the illustrated embodiment, the velocity sensor assembly 120 includes a Hall effect sensor 122. In other embodiments, any sensor may be used including, but not limited to, an accelerometer, a linear velocity sensor, a magnetic induction sensor, a microwave sensor, a fiber optic sensor, a piezoelectric sensor, a radar-base linear sensor or other sensors known to those of skill in the art upon a review of the present disclosure. The Hall effect sensor 122 is configured to measure a time (t) that the punch piston 46 moves past the Hall effect sensor 122 and within the range of the Hall effect sensor 122. A distance (d) corresponding to the time (t) is equal to a height of a head of the punch piston 46. In other words, the distance (d) is the length of a punch piston head 124, which is known, because the Hall effect sensor 122 starts measuring when the bottom of the punch piston head 124 crosses the Hall effect sensor 122 (FIG. 5A) and it stops measuring when the top of the punch piston head 124 passes the Hall effect sensor 122 (FIG. 5C). The time (t) and distance (d) is then used to calculate (by a processor such as the processor 208 shown in FIG. 6, for example) the velocity of the punch cylinder 32, and thus of the punch 40. The velocity (v) can calculated using the formula: $v=d*t$. The velocity (v) can be used to calculate other variables, such as a force (f) of the punch 40.

In some embodiments, the Hall effect sensor 122 measures the position of the head of the punch cylinder piston 46. The Hall effect sensor 122 may give an on/off signal based on position, i.e., it tracks how long the punch cylinder piston 46 is in the sensor's range when paired with a controller (such as the controller 204 shown in FIG. 6). The number of sample points are then used in combination with the controller 204 sample rate and sensor update frequency to determine the time duration that the punch piston 46 was in signal range of the Hall effect sensor 122. Since the mass of the moving punch assembly 30 is constant, the time duration that the punch piston 46 is in the range of the hall effect sensor 122 can be related to velocity of the punch piston 46 and the punch 40. The velocity can then be used to estimate if the kinetic energy and momentum met the minimum requirements to fully form the band lock (e.g., deformation of the band 2 to the buckle 6 to lock, clamp, or otherwise secure the band 2 to the workpiece 4).

For example, FIG. 5A shows the punch piston 46 at a time t1, FIG. 5B shows the punch piston 46 at a time t2, and FIG. 5C shows the punch piston 46 at a time t3. The Hall effect sensor 122 does not move. The sensor signal is low immediately before the punch piston 46 enters the Hall effect sensor's 122 signal range, i.e., at t1 shown in FIG. 5A. The sensor signal is high while the punch piston 46 is in the Hall effect sensor's 122 signal range, i.e., at t2 shown in FIG. 5B. The sensor signal returns to a low signal when the punch piston 46 reaches the bottom or end position and passes out of the Hall effect sensor's 122 signal range, i.e., at t3 shown in FIG. 5C.

The Hall effect sensor 122 will transmit the data to the processor 208, which will calculate the velocity of the punch 40 as described above and provide feedback to an operator. In some embodiments, the processor will compare the calculated velocity to a predetermined velocity threshold. If the calculated velocity is below the predetermined velocity threshold, a notification may be generated to the operator indicating that the calculated velocity is not in a desired range for proper buckle 6 formation. If the calculated velocity is at or above the predetermined velocity threshold, the notification may indicate that the velocity was acceptable. The notification may be communicated to the operator via a user interface (such as user interface 218 shown in FIG. 6) visually, audibly, or both.

If the velocity is determined to be slower than desired, then this may indicate that the release mechanism 38 and/or the rear wheel 62 may have impeded the downward movement of the punch driving linkage 36, which can slow down the punch piston 46 and punch 40. The notification would inform the operator that the punch 40 velocity was too slow and the tool 1 should be checked to ensure the release mechanism 38 and the rear wheel 62 are clean and operating as intended, meaning the release mechanism 38 fully clears. Alternatively, other portions of the tool may be dirty or comprise debris that is slowing down the punch 40 and/or piston 46; the system, specifically the punch assembly 30, may have leaky seals; or other maintenance may be needed) or the system pressure may be too low (or too high if the velocity is too high) and maintenance is needed.

A further embodiment of the present disclosure includes collecting, monitoring, and analyzing the sensor data generated by the sensor assemblies 70, 90, 120 described above and/or other sensors disposed on the tool 1. This beneficially provides for detecting if the installation process is correct through the captured data. Captured data output includes at least tension value, punch force, cut force, buckle position and/or orientation, buckle/workpiece tangency, and/or punch velocity or other characteristics. Data is captured throughout the above process and the operator is provided with feedback of installation quality through the system described with respect to FIG. 6. The data may be used to provide checks during the banding process and validate the banding process, as described with respect to FIGS. 7-8B and/or may be used to analyze and determine component wear, malfunction, or maintenance, as described with respect to FIGS. 9 and 10A-10B.

Figure 6:
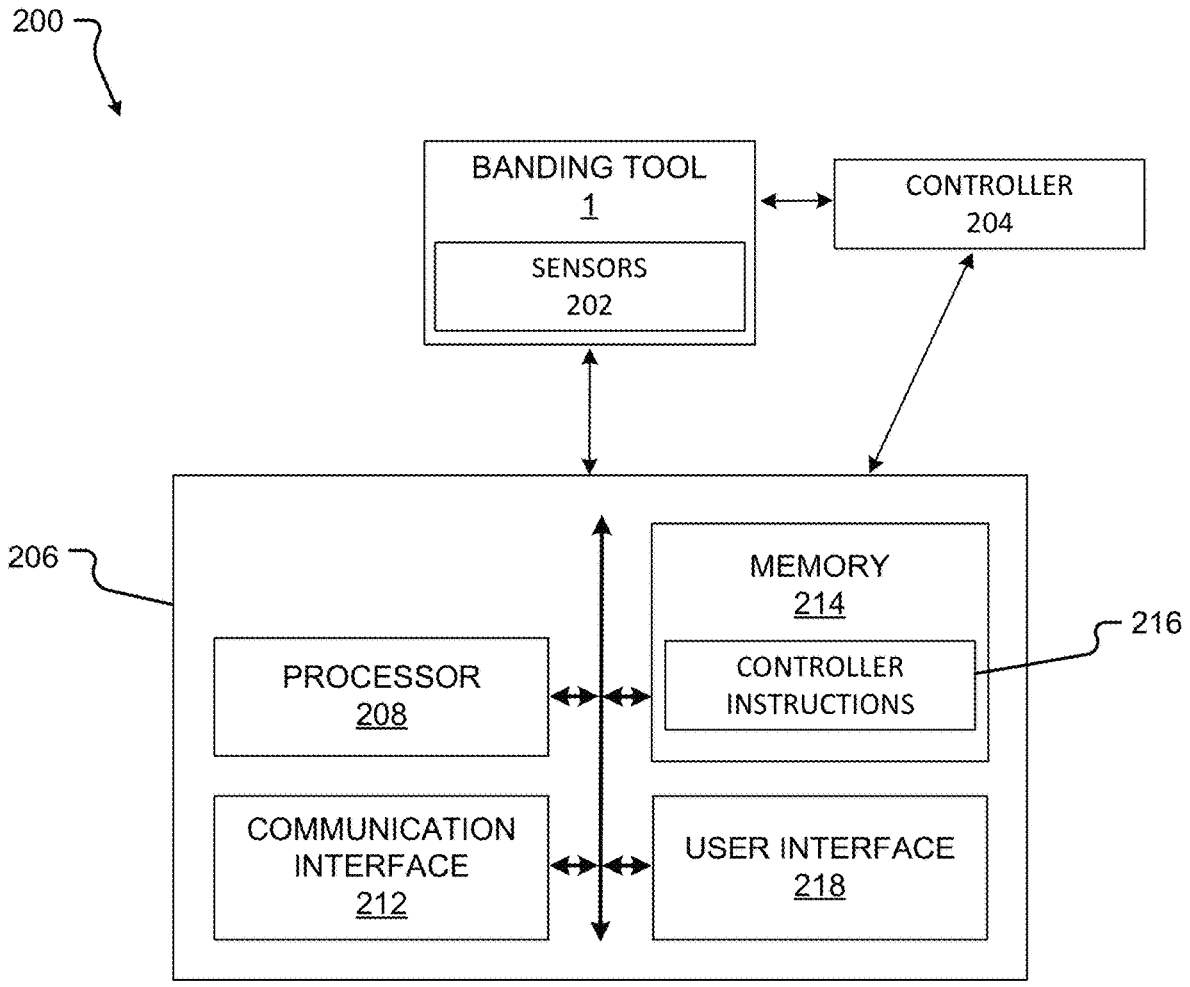
FIG. 6 is a block diagram of a system for validating a tensioning and locking procedure for a band according to one embodiment of the present disclosure.

Turning first to FIG. 6, a block diagram of a system 200 according to at least one embodiment of the present disclosure is shown. In some embodiments of the present disclosure, systems such as the system 200 of FIG. 6 may not include one or more of the illustrated components, may include other components not shown in FIG. 6, and/or may include components similar to, but not the same as, one or more components of the system 200 shown in FIG. 6. Further, a computing device such as computing device 206 in some embodiments may have more components or fewer components than the computing device 206.

The system 200 includes a special purpose computing device 206, a banding tool 1, and a controller 204. Embodiments of the banding tool 1 according to aspects of the present disclosure, as illustrated in FIG. 6, are described above with respect to FIGS. 1A-1B. The banding tool 1 includes sensors 202. Embodiments of sensors 202 according to aspects of the present disclosure, as illustrated in FIG. 6, are described above with respect to FIGS. 2A-5C. The computing device 206 that, according to embodiments of the present disclosure, may comprise a processor 208, a memory 214, a communication interface 212, and the user interface 218. The computing device 206 includes software programed to perform the various algorithms necessary to implement the sensing functions and subsequent actions triggered by the results of the sensor outputs as described herein.

The processor 208 of the computing device 206 may be any processor known to those of skill in the art capable of implementing and controlling the processes described herein. The processor 208 may be configured to execute instructions stored in the memory 214, which instructions may cause the processor 208 to carry out one or more computing steps utilizing or based on data received from the user interface 218, the at least one sensor 202, and/or the controller 204.

The memory 214 may be or comprise RAM, DRAM, SDRAM, other solid-state memory, any memory described herein, or any other tangible, non-transitory memory for storing computer-readable data and/or instructions. The memory 214 may store information or data useful for completing any step of the methods 700, 900 described herein. The memory 214 may store, for example, one or more controller instructions 216. Such instructions 216 and/or other stored algorithms may, in some embodiments, be organized into one or more applications, modules, packages, layers, or engines. The algorithms and/or instructions 216 may cause the processor 208 to manipulate data stored in the memory 214 and/or received from the sensors 202 and/or controller 204.

The computing device 206 may also comprise a communication interface 212. The communication interface 212 may be used for receiving sensor data or other information from an external source (such as the controller 204 and/or the at least one sensor 202), and/or for transmitting instructions, data, or other information to an external system or device (e.g., the controller 204 and/or the at least one sensor 202). The communication interface 212 may comprise one or more wired interfaces (e.g., a USB port, an ethernet port, a Firewire port) and/or one or more wireless interfaces (configured, for example, to transmit information via one or more wireless communication protocols such as 702.11a/b/g/n, Bluetooth, NFC, ZigBee, and so forth). In some embodiments, the communication interface 212 may be useful for enabling the computing device 206 to communicate with one or more other processors 208 or computing devices 206, whether to reduce the time needed to accomplish a computing-intensive task or for any other reason.

The computing device 206 may also comprise one or more user interfaces 218. The user interface 218 may be or comprise a keyboard, mouse, trackball, monitor, television, touchscreen, joystick, switch, button, audio speaker, lights, headset, eyewear, and/or any other device for receiving information from a user and/or for providing information to a user. The user interface 218 may be used, for example, to display the instructions for the controller 204, notifications, component errors, required maintenance, data from the sensors 202, or the like. In some embodiments, the user interface 218 may be useful to allow an operator to modify the instructions or other information displayed. In some embodiments, user input such as that described above may be optional or not needed for operation of the systems, devices, and methods described herein.

Although the user interface 218 is shown as part of the computing device 206, in some embodiments, the computing device 206 may utilize a user interface 218 that is housed separately from one or more remaining components of the computing device 206. In some embodiments, the user interface 218 may be located proximate one or more other components of the computing device 206, while in other embodiments, the user interface 218 may be located remotely from one or more other components of the computing device 206.

In the illustrated embodiment, the system 200 includes the controller 204. The controller 204 may be an electronic, a mechanical, or an electro-mechanical controller. The controller 204 may be, for example, a programmable logic control (PLC). The controller 204 may comprise or may be any processor described herein. The controller 204 may comprise a memory storing instructions for executing any of the functions or methods described herein as being carried out by the controller 204. In some embodiments, the controller 204 may be configured to simply convert signals received from the computing device 206 (e.g., via a communication interface 212) into commands for operating the banding tool 1. In other embodiments, the controller 204 may be configured to process and/or convert signals received from the sensors 202 and/or another controller 204.

Further, the controller 204 may receive signals from one or more sources (e.g., the sensor 202) and may output signals to one or more sources.

The system 200 also includes the at least one sensor 202. The at least one sensor 202 is operable to measure or monitor a characteristic of the system 200. The sensor 202 may output signals (e.g., sensor data) to one or more sources (e.g., the controller 204, and/or the computing device 206). The sensor 202 may include one or more or any combination of components that are electrical, mechanical, electro-mechanical, magnetic, electromagnetic, or the like. In some embodiments, the sensor 202 comprises one or more of the sensors described with respect to FIGS. 2A-5C including, but not limited to, a pressure sensor, a torque sensor, a load sensor, a position sensor assembly 70, a tangency sensor assembly 90, and/or a velocity sensor assembly 120. The characteristic may include, but is not limited to, one or more of tension (e.g., of the band 2), pressure (e.g., of the punch cylinder 32 and/or cut cylinder 52), force (e.g., of the punch 40 and/or force received by the buckle 6), motor speed, torque (e.g., of the motor 24), duration (e.g., of a pressure to reach a target pressure) or the like.

In some examples, the at least one sensor 202 may trigger the controller 204 (e.g., by sending a signal directly to the controller 204 or via the computing device 206) to actuate a component of the tool 1. For example, the at least one sensor 202 may trigger the controller 204 to release the release mechanism 38 for the punch 40. In other examples, the at least one sensor 202 may trigger an alert or a notification to an operator that a component is malfunctioning. For example, the notification may correspond to the punch velocity decreasing, thereby indicating that a component of the punch assembly 30 is malfunctioning. In further examples, the at least one sensor 202 may trigger the controller 204 to generate a pass/fail signal that may be communicated to the operator or stored in the memory 214.

Figure 7:
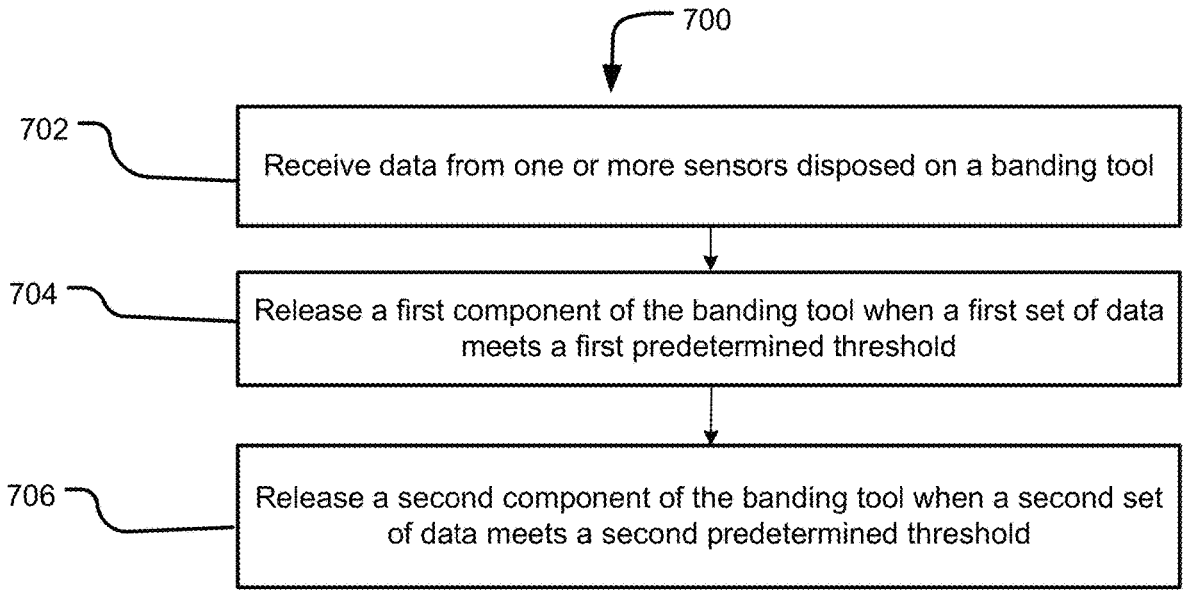
FIG. 7 is a flow diagram of a method for validating a tensioning and locking procedure for a band according to at least one embodiment of the present disclosure.

Turning to FIG. 7, a method 700 for controlling and activating components of the tool 1 for a banding process may be executed in whole or in part on a computing device 206. The method 700 may be performed using, for example, the system 200 described above with respect to FIG. 6 or 7, the tool 1 described above with respect to FIGS. 1A-1B, and the sensors 202 described above with respect to FIGS. 2A-5C.

The method 700 comprises receiving data from at least one sensor 202 disposed on or associated with the tool 1 (step 702). In some examples, the data may be received via the user interface 218 and/or communication interface 212 of a computing device 206 and may be stored in the memory 214. As described above, the at least one sensor 202 may include, but is not limited to, a pressure sensor, a torque sensor, a load sensor, a position sensor assembly 70, a tangency sensor assembly 90, and/or a velocity sensor assembly 120. The data outputted from the at least one sensor 202 may include, but is not limited to, positioning data generated by the position sensor assembly 70 and corresponding to a position of the buckle 6 relative to the punch assembly 30, punch data generated by a pressure sensor (e.g., a pressor transducer) and corresponding to the pressure of the punch cylinder 32, tangency data generated by the tangency sensor assembly 90 and corresponding to a tangency of the buckle 6 relative to the workpiece, tensioning data generated by a tensioning sensor and corresponding to a tensioning of the band 2 when the band 2 is in the band tensioning assembly 10, velocity data generated by the velocity sensor assembly 120 and corresponding to a velocity of the punch 40, and/or motor speed and/or torque of the motor 24.

The method 700 also comprises releasing or activating a first component of the tool 1 when a first set of data for the received data meets a first predetermined threshold (step 704). The first predetermined threshold may be received via the user interface 218 and/or communication interface 212 of a computing device 206, and may be stored in the memory 214, or may be generated by any component of the system 200. The first component may be any component described above with respect to the tool 1 including, but not limited to, any component of the punch assembly 30, any component of the cutting assembly 50, any component of the band tensioning assembly 10, or any other component of the tool 1. The first predetermined threshold may include, but is not limited to, a buckle positioning threshold, a tangency threshold, a punch threshold, a punch velocity threshold, and/or a tensioning threshold. The buckle positioning threshold validates that the buckle 6 is in a correct position and is perpendicular or substantially perpendicular to the punch 40; the tangency threshold validates that the buckle 6 in a correct position and is positioned tangent or substantially tangent (within an acceptable range of angles) to the workpiece; the punch threshold validates that the punch cylinder 32 has adequate pressure; the punch velocity threshold validates that the punch 40 had enough energy or momentum to lock the band 2 correctly; and the tensioning threshold validates that the band 2 is properly tensioned.

In one embodiment, the first component may comprise the punch 40 of the punch assembly 30, the first set of data may comprise one or more of the buckle positioning data, the tangency data, and the punch data, and the first predetermined threshold may comprise one or more of the buckle positioning threshold, the tangency threshold, and the punch threshold. In the same embodiment, the punch 40 releases or is activated when one or more of the positioning data meets the positioning threshold, thereby indicating that the buckle 6 of the band 2 is perpendicular or substantially perpendicular to the punch 40; the tangency data meets the buckle tangency threshold and is within a range of acceptable angles, thereby indicating that the buckle 6 is tangent or substantially tangent to the workpiece 4; and the punch data meets the punch threshold, thereby indicating that a pressure of the punch cylinder 32 has reached or exceeded a set pressure. Stated differently, the punch 40 is not released or activated until at least one of the buckle 6 is correctly positioned with respect to both the workpiece 4 and the punch 40 and the pressure of the punch cylinder 32 is adequate for the process.

In some embodiments, the punch 40 may be released when the position sensor assembly 70 has transmitted a signal to the controller 204 when the buckle 6 is in a correct position relative to the punch 40 and in the absence of the signal, the controller 204 does not release the punch 40. In other embodiments, the position sensor assembly 70 may transmit a signal to the controller 204 indicating that the buckle 6 is not in a correct position and may cause the controller 204 to not release the punch 40. The position sensor assembly 70 may then transmit a signal to the controller 204 when the buckle 6 is in the correct position to cause the controller 204 to release the punch 40.

In some embodiments, the punch 40 may be released when the tangency sensor assembly 90 has transmitted a signal to the controller 204 when the buckle 6 is in a correct position relative to the workpiece 4 and in the absence of the signal, the controller 204 does not release the punch 40. In other embodiments, the tangency sensor assembly 90 may transmit a signal to the controller 204 indicating that the buckle 6 is not in a correct position and may cause the controller 204 to not release the punch 40. The tangency sensor assembly 90 may then transmit a signal to the controller 204 when the buckle 6 is in the correct position to cause the controller 204 to release the punch 40.

In some embodiments, the punch 40 may be released when the sensor 202 has transmitted a signal to the controller 204 when a predetermined threshold is met for the pressure of the pump 40 and in the absence of the signal, the controller 204 does not release the punch 40. In other embodiments, the sensor 202 may transmit a signal to the controller 204 indicating that the pressure has not met the predetermined threshold and may cause the controller 204 to not release the punch 40. The sensor 202 may then transmit a signal to the controller 204 when the pressure has met the predetermined threshold to cause the controller 204 to release the punch 40.

In some examples, the band 2 may be held in tension for a first predetermined duration prior to releasing or activating the first component (e.g., the punch 40). If the first component is not released or activated within a set time, the tension may be released and the process will need to be reinitiated. The first predetermined duration may be received and communicated to an operator via the user interface 218 and/or communication interface 212 of a computing device 206, or may be generated by any component of the system 200. For example, the first predetermined duration may begin after each of the first set of data meets the corresponding first predetermined threshold. The first predetermined duration ensures that the buckle position sensor 32 is sufficiently engaged such that the punch 40 will fire perpendicular or substantially perpendicular to the buckle 6 face. This avoids a scenario in which the buckle 6 may contact the buckle position sensor 32, but disengage prior to the punch 40 releasing (e.g., switch bounce), thereby resulting in misalignment of the buckle 6 to the punch 40. The first predetermined duration may also provide a time period to allow for an operator to correct the positioning of the buckle 6 to satisfy the one or more preconditions to release or activation of the punch 40. In some embodiments, the first predetermined duration is 50 ms, though the first predetermined duration maybe greater than 50 ms or less than 50 ms. The user interface 218 may audibly and/or visually indicate that the one or more preconditions are met.

The method 700 further comprises releasing a second component of the tool 1 when a second set of data from the at least one sensor 202 meets a second predetermined threshold (step 706). The second predetermined threshold may be received and communicated to an operator via the user interface 218 and/or communication interface 212 of a computing device 206, or may be generated by any component of the system 200. The second component may be any component described above with respect to the tool 1 including, but not limited to, any component of the punch assembly 30, any component of the cutting assembly 50, any component of the band tensioning assembly 10, or any other component of the tool 1. Similarly, the second predetermined threshold may include, but is not limited to, one or more of the buckle positioning threshold, the tangency threshold, the punch threshold, the punch velocity threshold, and/or the tensioning threshold. In some embodiments, the second component comprises the punch assembly 30, the second set of data tensioning data, and the second predetermined threshold comprises completion of the tensioning process. In the same embodiments, the punch is activated when the tensioning assembly has completed its operation. Optionally, if all of the criteria are met for releasing or activating the punch assembly, it may be preferable to continue monitoring the tension assembly as a properly tensioned band contributes to a properly formed lip lock which advantageously adds to the retained strength of the completed band. Conversely, if the punch operation did not meet threshold criteria, monitoring the tension as part of the knife cutting operation is less helpful.

In some examples, the band 2 may be held in tension for a second predetermined duration prior to releasing or activating the second component (e.g., the knife 56). The second predetermined duration may be received and communicated to an operator via the user interface 218 and/or communication interface 212 of a computing device 206, or may be generated by any component of the system 200. For example, the second predetermined duration may begin after each of the second set of data meets the corresponding second predetermined threshold. In some examples, the second predetermined duration ensures that the buckle 6 can be repositioned if needed, provides time for the punch 40 to retract and for the motor 24 to pull slack out of the band 2 if the punch operation causes slipping, and that the band 2 is properly tensioned. This provides for a flush cut of the band 2 and proper formation of a lip lock. The second predetermined duration may allow an operator to correct the positioning of the buckle 6 for formation of the lip lock by the knife assembly. In some embodiments, the second predetermined duration is 50 ms, though the second predetermined duration maybe greater than 50 ms or less than 50 ms.

The method 700 may also include outputting at least one check (e.g., validation) to the operator. If all checks are validated, the operator may be notified audibly and/or visually that the banding process operated correctly and that the band 2 is properly formed. If one or more checks are not validated, these unvalidated checks may be communicated to the operator. The at least one check may include, but is not limited to, one or more of buckle alignment, buckle and workpiece tangency, punch velocity, punch force (as derived from punch velocity), pressure for the punch cylinder, pressure for the cut cylinder, motor torque, and/or motor velocity. In some examples, the method 700 includes communicating one or more of the positioning data, the punch data, the tangency data, the tensioning data, or a notification by at least one of audio or visual, wherein the notification validates the tensioning procedure and locking procedure for the band.

In some embodiments, the system 200 can also provide feedback that all of the thresholds are satisfied prior to releasing the punch 40. For example, if all of the sensors 202 are satisfied except for an alignment sensor, and the operator is moving the tool to gain acceptable positioning, he may receive an audio of visual signal that the all of the thresholds are satisfied which tells him to stop adjusting the position of the tool 1. Similarly, in another example, if all of the sensors 202 are satisfied except for a tangency sensor, and the operator is moving the workpiece to gain acceptable positioning, he may receive an audio of visual signal that the all of the thresholds are satisfied which tells him to stop adjusting the position of the workpiece.

Figure 8A:
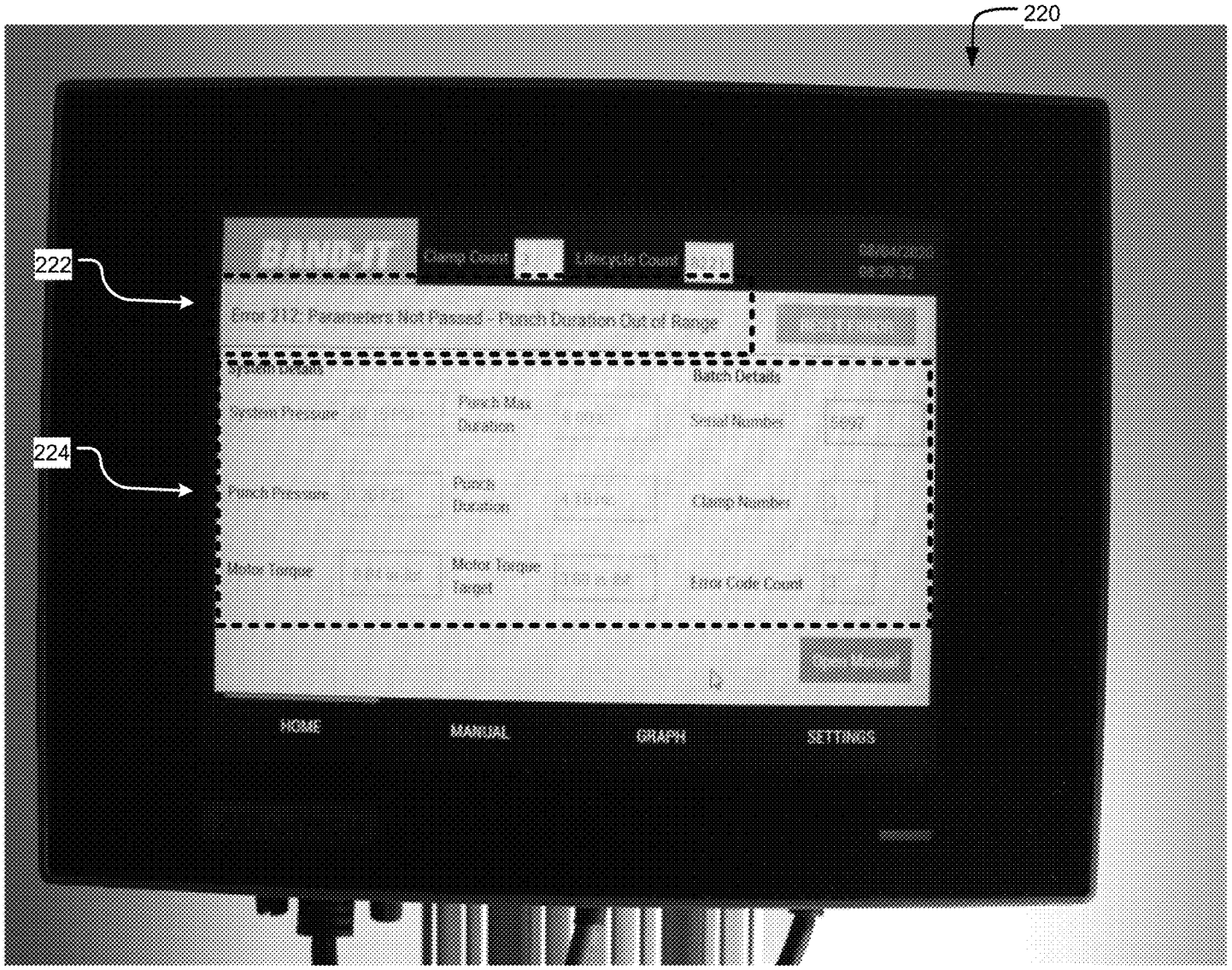
FIG. 8A is a screen shot of a display illustrating sensor data according to at least one embodiment.
Figure 8B:
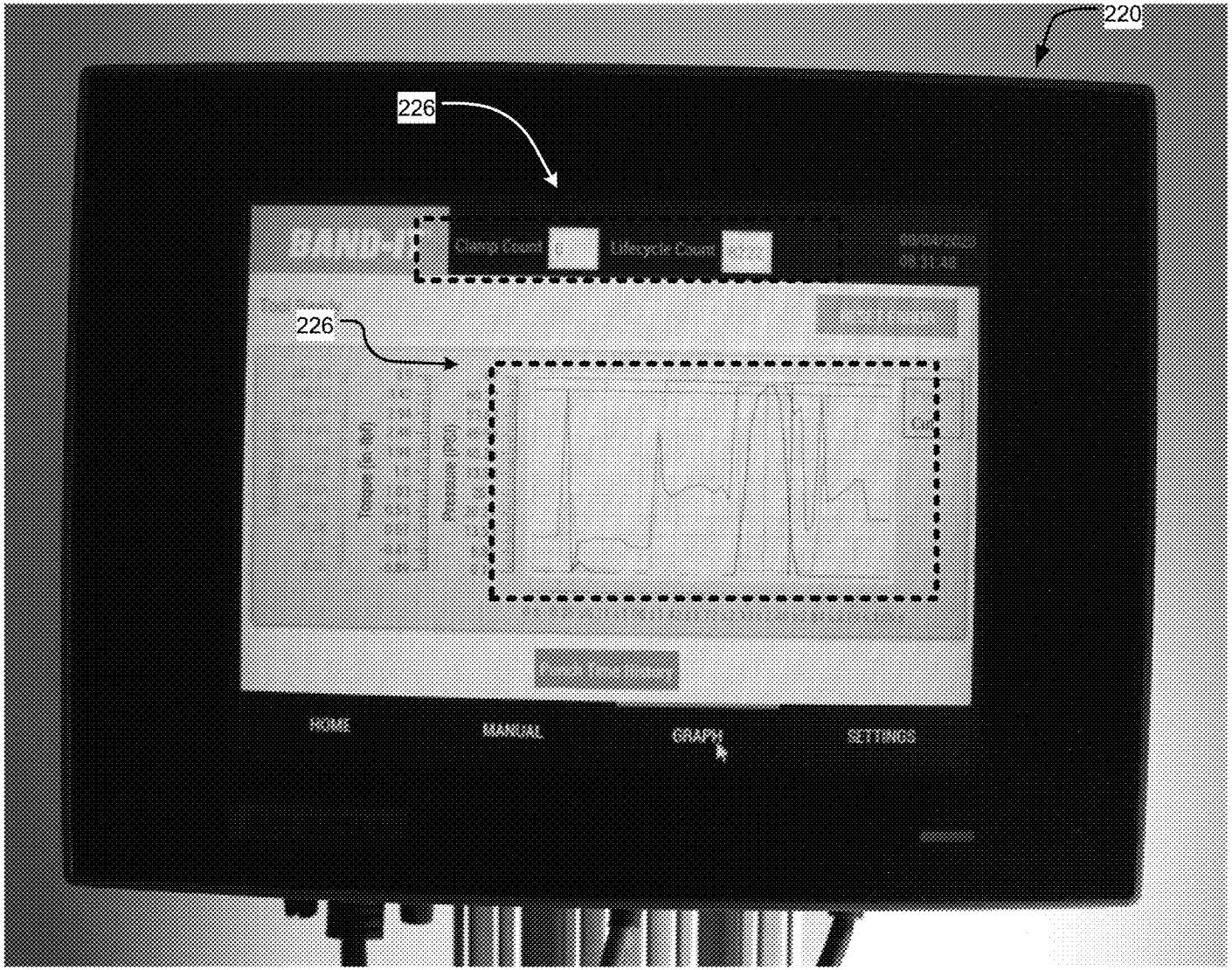
FIG. 8B is a screen shot of a display illustrating further sensor data according to at least one embodiment.

The checks and/or feedback or any output from the system 200 can be communicated on the user interface 218 such as a monitor 220 shown in FIGS. 8A-8B. The monitor 220 may visually (and/or audible) display parameters 224 that passed or did not pass their respective thresholds. For example, an error 222 is displayed in FIG. 8A and indicates that a punch duration was out of range. The operator may then check or redo the band locking operation with a new band and/or new buckle. The operator may also then check the tool 1 for issues. The monitor 220 may also display sensor data 226 in a graphical form. In other embodiments, the monitor 220 may display the sensor data 226 in any more such as, but not limited to, a table, a chart, a spreadsheet or the like. The monitor may also display a clamp count and a lifecycle count 228.

The method 700 may include fewer steps or more steps than the method 700 described above.

Figure 9:
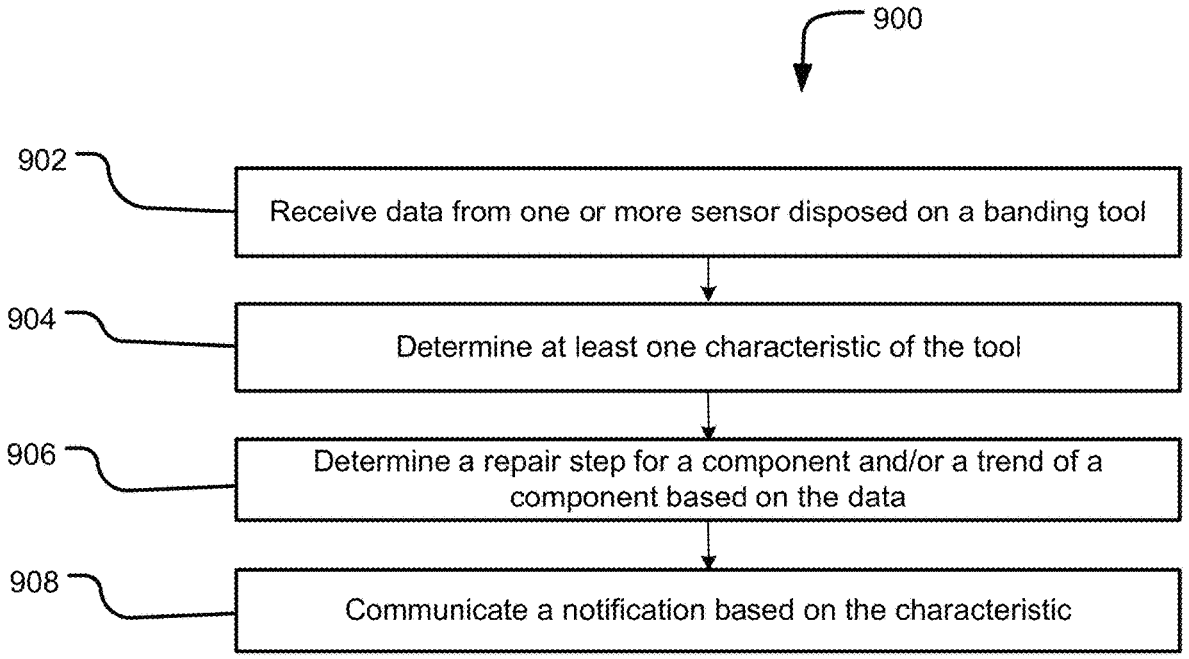
FIG. 9 is another flow diagram of a method for validating a tensioning and locking procedure for a band according to at least one embodiment of the present disclosure.

Turning to FIG. 9, a method 900 for determining a characteristic of the tool 1 based on one or more cycles of a banding process may be executed in whole or in part on a computing device 206. The method 900 may be performed using, for example, the system 200 described above with respect to FIG. 6, the tool 1 described above with respect to FIGS. 1A-1B, and the sensors 202 described above with respect to FIGS. 2A-5C.

The method 900 comprises receiving data from at least one sensor 202 disposed on the tool 1 (step 902). As similarly described with respect to step 702 above of method 700, in some examples, the data may be received via the user interface 218 and/or communication interface 212 of a computing device 206, and may be stored in the memory 214. As described above, the at least one sensor 202 may include, but is not limited to, a pressure sensor, a torque sensor, a load sensor, a position sensor assembly 70, a tangency sensor assembly 90, and/or a velocity sensor assembly 120. The data outputted from the at least one sensor 202 may include, but is not limited to, positioning data generated by the position sensor assembly 70 and corresponding to a position of the buckle 6 relative to the punch 40, punch data generated by a pressure sensor (e.g., a pressor transducer) and corresponding to the pressure of the punch cylinder 32, tangency data generated by the tangency sensor assembly 90 and corresponding to a tangency of the buckle 6 relative to the workpiece, tensioning data generated by the tensioning sensor and corresponding to tensioning of the band 2 when the band 2 is in the band tensioning assembly 10, velocity data generated by the velocity sensor assembly 120 and corresponding to a velocity of the punch 40, and/or motor speed and/or torque of the motor 24.

The method 900 also comprises determining at least one characteristic of the tool 1 based on the data received (step 904). The at least one characteristic includes, but is not limited to, one or more of tension (e.g., of the band 2), pressure (e.g., of the punch cylinder 32 and/or cut cylinder 52), force (e.g., of the punch 40 and/or force received by the buckle 6), motor speed, torque (e.g., of the motor 24), duration (e.g., of a pressure to reach a target pressure) or the like.

The method 900 also comprises determining a repair step for a component during the banding process and/or determining a trend of a component of the banding tool 1 based on the characteristic (step 906). The characteristic can indicate that a component needs immediate repairs or adjustments prior to operation of the tool 1. For example, a drop in a velocity of the punch 40 can indicate that the force of the punch 40 was insufficient and therefore the deformation of a buckle 6 and band 2 is deficient. In another example, a drop in the velocity of the punch 40 can indicate that friction is occurring in the punch assembly 30. In yet another example, a drop in a pressure of the punch cylinder 32 may indicate that a leak is occurring in the punch cylinder 32 and the pressure can be adjusted for a subsequent operation to overcome the friction.

The trend indicates wearing and/or malfunctioning of a component, which may be used to determine replacement of a component or to determine if a component needs immediate repairs. The method 900 may also comprise analyzing the trend to determine a predictive maintenance step prior to malfunctioning of the component or a repair or replacement step. The predictive maintenance step or cycle may be determined from a cycle count for a component. The cycle count may be monitored and used to output a signal or even lock the tool 1 when a component needs maintenance and/or replacement as indicated by the predictive maintenance step. The trend can also be used to design components with improved efficiency and/or wear. Data collected from multiple tools may be combined for establishing maintenance and repair schedules, for setting threshold values and for identifying trends.

The trend corresponds to, but is not limited to, one or more of a drop in a velocity of the punch 40 over one or more of a number of occurrences, an increase in a motor speed and lack of reaching a target torque, or an increase in time for a pressure of the punch cylinder 32 to reach a target pressure. The drop in the velocity can indicate that a component of the punch assembly 30 is malfunctioning. The drop in velocity may be analyzed together with adequate punch pressure. In some examples, the drop in the velocity coupled with adequate punch pressure may indicate that seals on the cylinder are worn, pins on a trigger linkage assembly need reapplication of grease, guide wheels on a punch holder and/or a trigger are worn, and/or debris has built up in a punch cavity. The increase in motor speed can indicate that maintenance is required for a component of the motor 24. For example, debris may have built up on the wheels and/or other component or slippage may be occurring and/or the tension wheel 22 needs to be cleaned or replaced. Motor torque can be monitored while pulling slack from the band 2 during the banding process to determine friction between a band 2 and a tension drive wheel 22 (e.g., tie friction), which can be used to improve band tolerance and performance. Motor torque can also be used to determine if the knife 56 is dulling and in need of repair or replacement. Motor speed and motor torque can also be used to estimate gearbox life and/or a replacement schedule for the gearbox. The drop in the pressure may indicate that an air flow rate is malfunctioning. This may be used to determine that the air supply and/or the controller 204 may need repair. If a pressure of the tool 1 is maintained, but pressure of the punch cylinder 32 is taking excessive amounts of time to pressurize, then a tubing harness between the tool 1 and the controller 204 may need repair or replacement.

The method 900 may also comprise analyzing the trend to determine a predictive maintenance step prior to malfunctioning of the component or a repair or replacement step during the banding process. The predictive maintenance step or cycle may be determined from a cycle count for a component. The cycle count may be monitored and used to lock the tool 1 when a component needs maintenance and/or replacement as indicated by the predictive maintenance step.

Figures 10A, 10B:
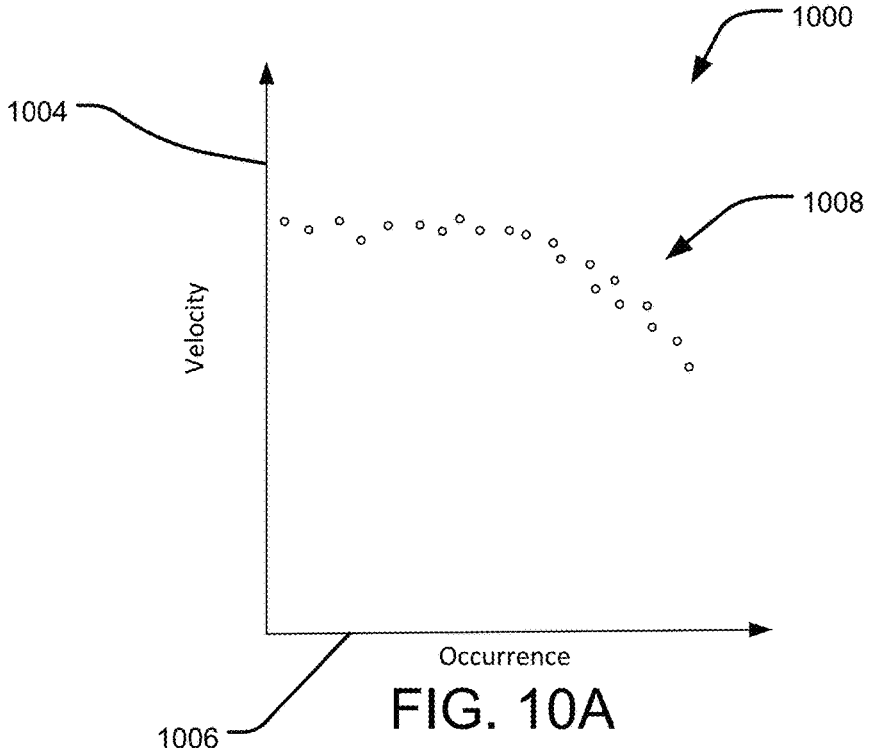
FIG. 10A is a chart illustrating a trend of a component characteristic according to one embodiment of the present disclosure.
FIG. 10B is a table illustrating values of a plurality of component characteristics according to one embodiment of the present disclosure.

The repair step and/or the trend may be determined from a graph 1000, as shown in FIG. 10A, or a table 1002, as shown in FIG. 10B. The table 1002 and/or graph 1000 may depict data for a specific tool, which may be identified by its serial number and/or may depict data for a specific operator. The data for the table 1002 and/or the graph 1000 may be updated for each component after each operation of the banding process using the tool 1.

The graph 1000 may be generated from the data and depict one or more characteristics 1004 (e.g., velocity) over a number of occurrences 1006. The graph 1000 may also depict a cycle after the buckle 6 and the band 2 are installed on the workpiece and may provide instant feedback for cycle performance (not shown). This may aid the user to troubleshoot the tool 1 by giving data over the whole cycle (e.g., operation). Further, timing of measurements shown in the graphs may be verified or analyzed by the operator. For example, the operator may verify that the punch 40 fired at the correct torque and not just that the adequate torque was reached.

The table 1002 may be constructed from the data depicting a trend 1014 numerically over a number of occurrences 1012 for a plurality of characteristics 1010. The table 1002 may be also be used to determine a count of one or more error codes (not shown). Error codes for a specific item may be used to monitor which error codes are most common for the item and can further be used to improve the item itself or use of the item.

The method 900 further comprises communicating a notification based on the repair step and/or the trend (step 908). The notification may be audibly and/or visually displayed. The notification can be based on the trend and correspond to one or more of a component malfunction, a component breakage, or a component maintenance. The notification can comprise error codes to troubleshoot specific errors, thereby reducing downtime associated with running checks on the entire tool 1. The notification can also be accompanied by locking the tool 1, thereby preventing use of a faulty tool 1.

The method 900 may include fewer steps or more steps than the method 900 described above.

As may be appreciated based on the foregoing disclosure, the present disclosure encompasses methods with fewer than all of the steps identified in FIGS. 7, 9 (and the corresponding description of the methods 700, 900), as well as methods that include additional steps beyond those identified in FIGS. 7, 9 (and the corresponding description of the methods 700, 900) and/or that include one or more steps other than those identified in FIGS. 7, 9 (and the corresponding description of the methods 700, 900). One or more steps of the methods described herein may be performed in an order other than the order in which they are described herein.

The various sensors and sensor assembly such as the position sensor assembly 70, the tangency sensor assembly 90, and/or the velocity sensor assembly 120 prevent the banding process from occurring when the buckle 6 and/or the workpiece 4 are not in the correct respective positions or alert an operator that the banding process may have been insufficient. Further, the systems and methods described above advantageously monitor, collect, and analyze data received from the sensors and/or sensor assemblies 70, 90, 120 to validate the banding process and/or to determine predictive maintenance schedules or identify repairs needed to the tool. Such validation and determination of maintenance and/or repairs of various components of the tool 1 ensures that the resulting band was properly installed and reduced downtime associated with a malfunctioning tool 1.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims.

What is claimed is:

1. A banding tool for fixing a band about a workpiece, the band having an associated buckle, comprising:

at least one location sensor, wherein the location sensor comprises a tangency sensor assembly configured to sense when the workpiece is in a correct position relative to the buckle;

at least one processor;

a memory storing instructions for execution by the at least one processor that, when executed, cause the at least one processor to:

receive tangency sensor data from the tangency sensor assembly indicating that a position of the buckle relative to the workpiece is correct, and cause the tool to lock the band relative to the buckle.

2. The banding tool of claim 1, further comprising:

a punch assembly having a punch configured to move from a first position spaced from the band and a second position in contact with the band;

a punch assembly sensor configured to sense a characteristic of the punch assembly; and wherein the memory stores additional instructions for execution by the at least one processor that, when executed, further cause the at least one processor to receive data from the punch assembly sensor.

3. The banding tool of claim 2, further comprising a controller configured to control the punch assembly;

wherein the punch assembly sensor is a pressure sensor configured to sense a pressure of a punch cylinder of the punch assembly; and wherein the data received from the punch assembly is pressure data associated with the punch cylinder, and when the pressure data shows an insufficient pressure, the controller prevents the punch from moving from the first position to the second position.

4. The banding tool of claim 1:

wherein the location sensor comprises a position sensor assembly configured to sense when the buckle is in a correct position relative to the banding tool; and wherein the memory stores additional instructions for execution by the at least one processor that, when executed, further cause the at least one processor to receive position sensor data from the position sensor assembly indicating that the buckle is in the correct position.

5. The banding tool of claim 4, wherein the position sensor assembly comprises at least one of an inductive sensor, a capacitive sensor, a photoelectric sensor, or an ultrasonic sensor.

6. The banding tool of claim 1, wherein the buckle is in a correct position relative to the workpiece when the tangency sensor data is within a range of an angle of deviation, and wherein the angle of deviation is measured at a centerline of the buckle and the workpiece and a bottom surface of the buckle.

7. The banding tool of claim 6, wherein the range is between 0 degrees and 7 degrees.

8. The banding tool of claim 1, wherein the tangency sensor assembly comprises at least one tangency contactor arm that is configured to contact a corresponding tangency contact when the workpiece is in the correct position relative to the buckle.

9. The banding tool of claim 8, wherein the tangency contact is an outwardly biased contact bearing.

10. The banding tool of claim 1, wherein the tangency sensor assembly comprises at least one of an inductive sensor, a capacitive sensor, a photoelectric sensor, or an ultrasonic sensor.

11. A banding tool for fixing a band about a workpiece, the band having an associated buckle, comprising:

at least one location sensor, the at least one location sensor comprising a position sensor assembly configured to sense when a buckle is in a correct position relative to the banding tool;

at least one processor;

a memory storing instructions for execution by the processor that, when executed, cause the processor to:

receive position sensor data from the position sensor assembly indicating that the buckle is in the correct position, and cause the tool to lock the band relative to the buckle.

12. The banding tool of claim 11, wherein the position sensor assembly comprises at least one of an inductive sensor, a capacitive sensor, a photoelectric sensor, or an ultrasonic sensor.

13. The banding tool of claim 11, wherein the at least one location sensor further comprises a tangency sensor assembly configured to sense when the workpiece is in a correct position relative to the buckle, wherein the memory stores additional instructions for execution by the at least one processor that, when executed, further cause the at least one processor to receive tangency sensor data from the tangency sensor assembly indicating that a position of the buckle relative to the workpiece is correct.

14. The banding tool of claim 13, wherein the tangency sensor assembly comprises at least one of an inductive sensor, a capacitive sensor, a photoelectric sensor, or an ultrasonic sensor.

15. The banding tool of claim 13, wherein the buckle is in the correct position relative to the workpiece when the tangency sensor assembly data is within a range of an angle of deviation, wherein the angle of deviation is measured at a centerline of the buckle and the workpiece and a bottom surface of the buckle.

16. The banding tool of claim 15, wherein the range is between 0 degrees and 7 degrees.

17. The banding tool of claim 11, further comprising:

a punch assembly having a punch configured to move from a first position spaced from the band and a second position in contact with the band;

a controller configured to control the punch assembly; and a punch assembly sensor configured to sense a characteristic of the punch assembly, wherein the memory stores additional instructions for execution by the at least one processor that, when executed, further cause the at least one processor to receive data from the punch assembly sensor.

18. A banding tool for fixing a band about a workpiece, the band having an associated buckle, comprising:

at least one sensor configured to sense at least one of a position of the buckle relative to the banding tool and the position of the buckle relative to the workpiece;

a processor; and a memory storing instructions for execution by the processor that, when executed, cause the processor to:

receive sensor data from the at least one sensor indicating at least one of the buckle is in a correct position relative to the banding tool and the buckle is in a correct position relative to the workpiece, and cause the tool to lock the band relative to the buckle.

19. The banding tool of claim 18, wherein the at least one sensor comprises a tangency sensor assembly having at least one of an inductive sensor, a capacitive sensor, a photoelectric sensor, and an ultrasonic sensor for sensing the position of the buckle relative to the workpiece.

20. The banding tool of claim 18, wherein the at least one sensor comprises a position sensor assembly having at least one of an inductive sensor, a capacitive sensor, a photoelectric sensor, and an ultrasonic sensor for sensing the position of the buckle relative to the banding tool.

* * * * *